US007137857B2

(12) United States Patent
George et al.

(10) Patent No.: US 7,137,857 B2
(45) **Date of Patent: *Nov. 21, 2006**

(54) METHOD FOR MANUFACTURING A LIGHT-EMITTING PANEL

(75) Inventors: Edward Victor George, Lake Arrowhead, CA (US); Roger Laverne Johnson, Encinitas, CA (US); Albert Myron Green, Springfield, VA (US); Newell Convers Wyeth, Oakton, VA (US)

(73) Assignee: Science Applications International Corporation, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/417,256

(22) Filed: Apr. 17, 2003

(65) Prior Publication Data

US 2004/0004445 A1 Jan. 8, 2004

Related U.S. Application Data

(63) Continuation of application No. 09/697,345, filed on Oct. 27, 2000, now Pat. No. 6,570,335.

(51) Int. Cl.
*H01J 9/00* (2006.01)

(52) U.S. Cl. ..... 445/24; 445/62

(58) Field of Classification Search ..... 315/169.3, 315/169.4; 313/484–486, 501, 506, 581–582, 313/306–307; 445/24, 62
See application file for complete search history.

(56) References Cited

U.S. PATENT DOCUMENTS

| | | | | |
|---|---|---|---|---|
| 3,559,190 A | | 1/1971 | Blitzer et al. | 340/173 |
| 3,646,384 A | | 2/1972 | Lay | 313/109.5 |
| 3,704,052 A | | 11/1972 | Coleman | 316/17 |
| 3,755,027 A | | 8/1973 | Gilsing | 156/67 |
| 3,789,471 A | * | 2/1974 | Spindt et al. | 445/52 |
| 3,848,248 A | | 11/1974 | MacIntyre, Jr. | 340/324 M |
| 3,969,651 A | | 7/1976 | Greeson, Jr. | 315/169 TV |
| 3,990,068 A | | 11/1976 | Mayer et al. | 340/324 M |
| 3,998,618 A | | 12/1976 | Kreick et al. | 65/105 |
| 4,027,246 A | | 5/1977 | Caccoma et al. | 235/151.1 |
| 4,035,690 A | | 7/1977 | Roeber | 315/169 TV |
| 4,143,297 A | * | 3/1979 | Fischer | 313/502 |
| 4,233,623 A | * | 11/1980 | Pavliscak | 348/797 |
| 4,303,433 A | | 12/1981 | Torobin | 65/21.4 |
| 4,320,418 A | * | 3/1982 | Pavliscak | 348/797 |
| 4,379,301 A | | 4/1983 | Fischbeck | 346/1.1 |
| 4,386,358 A | | 5/1983 | Fischbeck | 346/1.1 |
| 4,393,326 A | | 7/1983 | Kamegaya et al. | 313/582 |
| 4,429,303 A | | 1/1984 | Aboelfotoh | 340/701 |
| 4,534,743 A | | 8/1985 | D'Onofrio et al. | 445/24 |
| 4,554,537 A | | 11/1985 | Dick | 340/775 |

(Continued)

FOREIGN PATENT DOCUMENTS

JP 4-287397 10/1992

(Continued)

OTHER PUBLICATIONS

Preliminary Examination Report for Application No. PCT/US01/42782, dated Jun. 4, 2003 (mailing date).

(Continued)

*Primary Examiner*—Thuy Vinh Tran
(74) *Attorney, Agent, or Firm*—Kilpatrick Stockton LLP

(57) ABSTRACT

An improved light-emitting panel having a plurality of micro-components sandwiched between two subtrates is disclosed. Each micro-component contains a gas or gas-mixture capable of ionization when a sufficiently large voltage is supplied across the micro-component via at least two electrodes. An improved method of energizing a micro-component is also disclosed.

10 Claims, 18 Drawing Sheets

U.S. PATENT DOCUMENTS 4,563,617 A 1/1986 Davidson ..... 315/312
4,591,847 A 5/1986 Criscimagna et al. ..... 340/776
4,654,561 A 3/1987 Shelton ..... 315/111.71
4,658,269 A 4/1987 Rezanka ..... 346/75
4,697,123 A 9/1987 Shinoda et al. ..... 315/169.4
4,728,864 A 3/1988 Dick ..... 315/169.3
4,833,463 A 5/1989 Dick et al. ..... 340/775
4,843,281 A 6/1989 Mendelsohn ..... 313/587
4,887,003 A 12/1989 Parker ..... 313/634
4,912,364 A 3/1990 Hollo et al. ..... 313/623
5,019,807 A 5/1991 Stapleton et al. ..... 340/718
5,030,888 A 7/1991 Salavin et al. ..... 315/169.4
5,062,916 A 11/1991 Aufderheide et al. ..... 156/269
5,068,916 A 11/1991 Harrison et al. ..... 455/39
5,075,597 A 12/1991 Salavin et al. ..... 315/169.4
5,126,632 A 6/1992 Parker ..... 313/634
5,150,007 A 9/1992 Andreadakis ..... 313/586
5,315,129 A 5/1994 Forrest et al. ..... 257/21
5,396,149 A 3/1995 Kwon ..... 313/486
5,500,287 A 3/1996 Henderson ..... 428/403
5,501,871 A 3/1996 Henderson ..... 427/160
5,510,678 A 4/1996 Sakai et al. ..... 315/58
5,514,934 A 5/1996 Matsumoto et al. ..... 313/607
5,674,351 A 10/1997 Lovoi ..... 156/629.1
5,675,212 A 10/1997 Schmid et al. ..... 313/422
5,686,790 A 11/1997 Curtin et al. ..... 313/493
5,703,436 A 12/1997 Forrest et al. ..... 313/506
5,707,745 A 1/1998 Forrest et al. ..... 428/432
5,721,160 A 2/1998 Forrest et al. ..... 438/28
5,725,787 A 3/1998 Curtin et al. ..... 216/25
5,746,635 A 5/1998 Spindt et al. ..... 445/24
5,747,931 A 5/1998 Riddle et al. ..... 313/581
5,755,944 A 5/1998 Haven et al. ..... 204/486
5,757,026 A 5/1998 Forrest et al. ..... 257/40
5,757,131 A 5/1998 Tsuchiya ..... 375/582
5,757,139 A 5/1998 Forrest et al. ..... 315/169.3
5,777,782 A 7/1998 Sheridon ..... 359/296
5,788,814 A 8/1998 Sun et al. ..... 204/297 R
5,793,158 A 8/1998 Wedding, Sr. ..... 313/493
5,798,604 A 8/1998 Duboc, Jr. et al. ..... 313/495
5,808,403 A 9/1998 Clerc ..... 313/336
5,811,833 A 9/1998 Thompson ..... 257/40
5,815,306 A 9/1998 Sheridon et al. ..... 359/296
5,825,451 A 10/1998 Ma et al. ..... 349/187
5,837,221 A 11/1998 Bernstein et al. ..... 424/9.52
5,844,363 A 12/1998 Gu et al. ..... 313/506
5,853,446 A 12/1998 Carre et al. ..... 65/17.3
5,862,054 A 1/1999 Li ..... 364/468.28
5,865,657 A 2/1999 Haven et al. ..... 445/24
5,897,414 A 4/1999 Bergeron et al. ..... 445/3
5,898,266 A 4/1999 Spindt et al. ..... 313/495
5,913,704 A 6/1999 Spindt et al. ..... 445/24
5,914,150 A 6/1999 Porter et al. ..... 427/77
5,917,646 A 6/1999 Sheridon ..... 359/296
5,920,080 A 7/1999 Jones ..... 257/40
5,945,174 A 8/1999 Shaw et al. ..... 427/509
5,949,513 A 9/1999 Ma et al. ..... 349/187
5,953,587 A 9/1999 Forrest et al. ..... 438/99
5,964,630 A 10/1999 Slusarczuk et al. ..... 445/25
5,965,109 A 10/1999 Lohrmann ..... 424/9.52
5,967,871 A 10/1999 Kaake et al. ..... 445/24
5,969,472 A 10/1999 Kisner ..... 313/484
5,975,683 A 11/1999 Smith et al. ..... 347/55
5,984,747 A 11/1999 Bhagavatula et al. ..... 445/24
5,985,460 A 11/1999 Wang et al. ..... 428/426
5,986,409 A 11/1999 Farnworth et al. ..... 315/169.4
5,990,614 A 11/1999 Spindt ..... 313/495
5,990,620 A 11/1999 Lepselter ..... 313/585
6,002,198 A 12/1999 Spindt et al. ..... 313/292
6,013,538 A 1/2000 Burrows et al. ..... 438/22
6,017,584 A 1/2000 Albert et al. ..... 427/213.3
6,019,657 A 2/2000 Chakvorty et al. ..... 445/24
6,022,652 A 2/2000 Haven et al. ..... 430/26
6,023,259 A 2/2000 Howard et al. ..... 345/76
6,025,097 A 2/2000 Drumm ..... 430/7
6,030,269 A 2/2000 Drumm ..... 445/52
6,030,715 A 2/2000 Thompson et al. ..... 428/690
6,033,547 A 3/2000 Trau et al. ..... 204/622
6,037,710 A 3/2000 Poole et al. ..... 313/422
6,037,918 A 3/2000 Hansen et al. ..... 345/74
6,038,002 A 3/2000 Song ..... 349/43
6,039,619 A 3/2000 Kang et al. ..... 445/24
6,045,930 A 4/2000 Thompson et al. ..... 428/690
6,046,543 A 4/2000 Bulovic et al. ..... 313/504
6,048,469 A 4/2000 Xiang et al. ..... 252/301.6 R
6,048,630 A 4/2000 Burrows et al. ..... 428/690
6,049,366 A 4/2000 Hakemi et al. ..... 349/86
6,069,443 A 5/2000 Jones et al. ..... 313/504
6,072,276 A 6/2000 Okajima ..... 313/581
6,079,814 A 6/2000 Lean et al. ..... 347/55
6,080,606 A 6/2000 Gleskova et al. ..... 438/151
6,087,196 A 7/2000 Sturm et al. ..... 438/29
6,091,195 A 7/2000 Forrest et al. ..... 313/504
6,091,380 A 7/2000 Hashimoto et al. ..... 345/60
6,091,874 A 7/2000 Higashi et al. ..... 384/130
6,097,147 A 8/2000 Baldo et al. ..... 313/506
6,130,655 A 10/2000 Lammers ..... 345/72
6,137,553 A 10/2000 Izumi et al. ..... 349/49
6,201,518 B1 3/2001 Kane et al. ..... 345/60
6,255,777 B1 7/2001 Kim et al. ..... 313/582
6,262,706 B1 7/2001 Albert et al. ..... 345/107
6,265,826 B1 7/2001 Miyazaki ..... 313/586
6,281,863 B1 8/2001 Sasaki et al. ..... 345/60
6,285,129 B1 9/2001 Park et al. ..... 313/586
6,288,488 B1 9/2001 Amemiya ..... 313/582
6,288,693 B1 9/2001 Song et al. ..... 345/68
6,291,925 B1 9/2001 Jacobson ..... 310/319
6,292,159 B1 9/2001 Someya et al. ..... 345/60
6,292,160 B1 9/2001 Mikoshiba et al. ..... 345/60
6,295,040 B1 9/2001 Nhan et al. ..... 345/60
6,296,539 B1 10/2001 Awaji et al. ..... 445/24
6,297,590 B1 10/2001 Nanto et al. ..... 313/586
6,300,152 B1 10/2001 Kim ..... 438/30
6,300,932 B1 10/2001 Albert ..... 345/107
6,304,031 B1 10/2001 Wani et al. ..... 313/582
6,304,032 B1 10/2001 Asano ..... 313/582
6,304,238 B1 10/2001 Tsuchida ..... 345/87
6,307,319 B1 10/2001 Lee ..... 313/590
6,312,304 B1 11/2001 Duthaler et al. ..... 445/24
6,312,971 B1 11/2001 Amundson et al. ..... 438/99
6,319,325 B1 11/2001 Hiratsuka et al. ..... 118/718
6,322,010 B1 11/2001 Sasaki et al. ..... 239/568
2001/0008825 A1 7/2001 Toyoda et al. ..... 445/24
2001/0033256 A1 10/2001 Moore ..... 345/60
2001/0053570 A1 12/2001 Kido ..... 438/149
2002/0008470 A1 1/2002 Uegaki et al. ..... 313/567
2002/0009536 A1 1/2002 Iguchi et al. ..... 427/10
2002/0016075 A1 2/2002 Peng et al. ..... 438/700
2002/0017864 A1 2/2002 Watanabe et al. ..... 313/586
2002/0022565 A1 2/2002 Sreeram et al. ..... 501/16
2002/0024295 A1 2/2002 Miyashita et al. ..... 313/495

FOREIGN PATENT DOCUMENTS

JP 10-3869 1/1998
WO WO 00/36465 6/2000

OTHER PUBLICATIONS

International Search Report for Application No. PCT/US01/42805, dated Apr. 3, 2003 (mailing date).
Written Opinion for Application No. PCT/US01/42782, dated Dec. 31, 2002 (mailing date).
International Search Report for Application No. PCT/US01/42803, dated Dec. 9, 2002 (mailing date).

Preliminary Examination Report for Application No. PCT/US01/42807, dated Dec. 8, 2002 (mailing date).
Jacobson, et al., "The Last Book" [online] *IBM Systems Journal*, vol. 36, No. 3, 1997 [retrieved on Dec. 4, 2002], 6 pp., Retrieved from the Internet: http://www.research.ibm.com/journal/sj/363/Jacobson.html.
Peterson, "Rethinking Ink" [online], *Science News*, vol. 153, No. 25, Jun. 20, 1998 [retrieved on Dec. 4, 2002], 7 pp., Retrieved from the Internet: http://www.sciencenews.org/sn_arc98/6_20_98/bob2.htm.
Franjione, et al., "The Art and Science of Microencapsulation" [online], *Technology Today*, Summer, 1995 [retrieved on Dec. 4, 2002], 10 pp., Retrieved from the Internet: http://www.swri.edu/3pubs/ttoday/summer95/microeng.htm.
International Search Report for Application No. PCT/US01/51439, dated Sep. 23, 2002 (mailing date).
Written Opinion for Application No. PCT/US01/42807, dated Sep. 17, 2002 (mailing date).
International Search Report for Application No. PCT/US01/42807, dated May 20, 2002 (mailing date).
International Search Report for Application No. PCT/US01/42782, dated Apr. 11, 2002 (mailing date).
Sheats, James, "Introduction to Organic Light-Emitting Diodes (OLEDs)" [online], [retrieved on May 9, 2002], 8 pp., Retrieved from the Internet: http://www.rolltronics.com/intro_oled.htm.
Sauvante, Michael, "Roll-to-Roll Manufacturing" [online], [retrieved on May 9, 2002], 4 pp., Retrieved from the Internet: http://www.rolltronics.com/roll2roll.htm.
Veronis, Georgios and Inan, Umran S., "Optimization of the Luminous Efficiency of Plasma Display Panels Using Numerical Modeling" [online], [retrieved on Mar. 13, 2002], 8 pp., Retrieved from the Internet: http:/www-star.stanford.edu/~vlf/plasma_display/index.htm.
Smilgys, Russell, et al., "Progress Toward Roll Processing of Solar Reflective Material," *Proceedings of Solar Forum 2001 Solar Energy: The Power to Choose*, Washington, DC, 8 pp., Apr. 21-25, 2001.
Srinivasan, Uthara, et al., "Microstructure to Substrate Self-Assembly Using Capillary Forces," *Journal of Microelectromechanical Systems*, vol. 10, No. 1, Mar. 2001, pp. 17-24.
"Runco Plasma Wall Systems with Vivex Processing" [online], Copyright 2001 [retrieved on Jan. 17, 2002], 2 pp., Retrieved from the Internet: http://www.runco.com/Products/Plasma/Default.htm.
"Runco Plasma Wall PL-42cx" [online], Copyright 2001 [retrieved on Jan. 17, 2002], 2 pp., Retrieved from the Internet: http://www.runco.com/Products/Plasma/PL42cx.htm.
"Runco Plasma Wall Pl-50c" [online], Copyright 2001 [retrieved on Jan. 17, 2002], 2 pp., Retrieved from the Internet: http://www.runco.com/Products/Plasma/PL50c.htm.
"Runco Plasma Wall™ PL-61cx" [online], Copyright 2001 [retrieved on Jan. 17, 2002], 2 pp., Retrieved from the Internet: http://www.runco.com/Products/Plasma/PL61.htm.
"Electronics & Telecommunications" [online], LG Electronics, Copyright 2001 [retrieved on Nov. 7, 2001], 1 p., Retrieved from the Internet: http://www.lg.co.kr/English/company/electronic/index.jsp?code=A3.
"New Product" [online], LG Electronics, Copyright 2001 [retrieved on Nov. 7, 2001], 1 p., Retrieved from the Internet: http://www.lge.com.
"Monitor" [online], LG Electronics, Copyright 2001 [retrieved on Nov. 7, 2001], 2 pp., Retrieved from the Internet: http://www.lgeus.com/Product/Monitor/newmonitors.asp.
"LG Electronics Introduces 42-Inch Digital PDP TV" [online], LG Electronics, Copyright 2001 [retrieved on Nov. 7, 2001], 2 pp., Retrieved from the Internet: http://www.pdpdisplay.com/eng/news/e_read.as?nSeqno=22.
"LG PDP Now Available at World Renowned Harrods Department Store" [online], LG Electronics, Copyright 2001 [retrieved on Nov. 7, 2001], 2 pp., Retrieved from the Internet: http://www.pdpdisplay.com/eng/news/e_read/asp?nSeqno21.
"LG Electronics Becomes First in Korea to Export PDP Module" [online], LG Electronics, Copyright 2001 [retrieved on Nov. 7, 2001], 2 pp., Retrieved from the Internet: http://www.pdpdisplay.com/eng/news/e_read.asp?nSeqNo=19&type=&word=.
"LG Electronics—To the Top in PDP Business" [online], LG Electronics, Copyright 2001[retrieved on Nov. 7, 2001], 2 pp., Retrieved from the Internet: http://www.pdpdisplay,com/eng/news/e_read.asp?nSeqNo=16&type=&word=.
"LG Electronics Becomes the First in Korea to Export PDP" [online], LG Electronics, Copyright 2001 [retrieved on Nov. 7, 2001], 2 pp., Retrieved from the Internet: http://www.pdpdisplay.com/eng/news/e_read.asp?nSeqNo=14&type=&word=.
"LG Electronics Held the Ceremony for the Completion of the PDP Factory" [online], LG Electronics, Copyright 2001 [retrieved on Nov. 7, 2001], 2 pp., Retrieved from the Internet: http://www.pdpdisplay.com/eng/news/e_read.asp?nSeqNo=13&type=&word.
Chutinan, Alongkarn and Noda, Susumu, "Waveguides and Waveguide Bends in Two-Dimensional Photonic Crystal Slabs," *The American Physical Society*, vol. 62, No. 7, 5 pp., Aug. 15, 2000.
"Rolltronics" [online], Feb. 20, 2000 [retrieved on Mar. 12, 2000], 13 pp., Retrieved from the Internet: http://www.rolltronics.com.
Alien Technology Corporation's Technology Overview; Copyright © 2000, Alien Technology™; http://www.alientechnology.com/d/technology/overview.html.
Anonymous, "Alien Technology Corporation White Paper—Fluidic Self Assembly", Alien Technology Corp., Oct. 1999, pp. 1-7.
Kurihara, M. Makabe, T., "Two-Dimensional Modeling of a Micro-Cell Plasma in Xe Driven by High Frequency," *IEEE Transactions on Plasma Science*, vol. 27, No. 5, Oct. 1999, pp. 1372-1378.
Raulf, S., Kushner, M.J., "Operation of a Coplanar-Electrode Plasma Display Panel Cell," *IEEE Transactions on Plasma Science*, vol. 27, No. 1, Feb. 1999, pp. 10-11.
Shin, Y.K., Lee, J.K., Shon, C.H., "Two-Dimensional Breakdown Characteristics of PDP Cells for Varying Geometry," *IEEE Transactions on Plasma Science*, vol. 27, No. 1, Feb. 1999, pp. 14-15.
"Transparent Conductive Coatings," Copyright 1998, 4 pp.
Lin, Yi-Zhen, et al., "A New Method of Analyzing the Light Transmission in Leaky and Absorbing Planar Waveguides," *IEEE Photonics Technology Letters*, vol. 9, No. 9, Sep. 1997, pp. 1241-.
Stearns, Thomas H., "Flexible Printed Circuity," 6 pp., 1996.
"Flat Panel Displays in Perspective," 44 pp., Sep. 1995.
Preliminary Examination Report for Application No. PCT/US01/42803, dated Sep. 22, 2003 (mailing date).

* cited by examiner

METHOD FOR MANUFACTURING A LIGHT-EMITTING PANEL

CROSS-REFERENCE TO RELATED APPLICATIONS

The current application is a continuation application of U.S. application Ser. No. 09/697,345, filed Oct. 27, 2000 and titled A Method and System for Energizing a Micro-Component in a Light-Emitting Panel, now U.S. Pat. No. 6,570,335. The following applications filed on the same date as the present application are herein incorporated by reference: U.S. patent application Ser. No. 09/697,346 entitled A Socket for Use with a Micro-Component in a Light-Emitting Panel filed Oct. 27, 2000, now U.S. Pat. No. 6,545,422; U.S. patent application Ser. No. 09/697,358 entitled A Micro-Component for Use in a Light-Emitting Panel filed Oct. 27, 2000, now U.S. Pat. No. 6,762,566; U.S. patent application Ser. No. 09/697,498 entitled A Method for Testing a Light-Emitting Panel and the Components Therein filed Oct. 27, 2000, now U.S. Pat. No. 6,620,012; and U.S. patent application Ser. No. 09/697,344 entitled A Light-Emitting Panel and a Method of Making filed Oct. 27, 2000, now U.S. Pat. No. 6,612,889.

BACKGROUND OF THE INVENTION

1. Field of the Invention

The present invention is directed to a light-emitting panel and methods of fabricating the same. The present invention further relates to a method and system for energizing micro-components in a light-emitting panel.

2. Description of Related Art

In a typical plasma display, a gas or mixture of gases is enclosed between orthogonally crossed and spaced conductors. The crossed conductors define a matrix of cross over points, arranged as an array of miniature picture elements (pixels), which provide light. At any given pixel, the orthogonally crossed and spaced conductors function as opposed plates of a capacitor, with the enclosed gas serving as a dielectric. When a sufficiently large voltage is applied, the gas at the pixel breaks down creating free electrons that are drawn to the positive conductor and positively charged gas ions that are drawn to the negatively charged conductor. These free electrons and positively charged gas ions collide with other gas atoms causing an avalanche effect creating still more free electrons and positively charged ions, thereby creating plasma. The voltage level at which this ionization occurs is called the write voltage.

Upon application of a write voltage, the gas at the pixel ionizes and emits light only briefly as free charges formed by the ionization migrate to the insulating dielectric walls of the cell where these charges produce an opposing voltage to the applied voltage and thereby extinguish the ionization. Once a pixel has been written, a continuous sequence of light emissions can be produced by an alternating sustain voltage. The amplitude of the sustain waveform can be less than the amplitude of the write voltage, because the wall charges that remain from the preceding write or sustain operation produce a voltage that adds to the voltage of the succeeding sustain waveform applied in the reverse polarity to produce the ionizing voltage. Mathematically, the idea can be set out as $V_s=V_w-V_{wall}$, where $V_s$ is the sustain voltage, $V_w$ is the write voltage, and $V_{wall}$ is the wall voltage. Accordingly, a previously unwritten (or erased) pixel cannot be ionized by the sustain waveform alone. An erase operation can be thought of as a write operation that proceeds only far enough to allow the previously charged cell walls to discharge; it is similar to the write operation except for timing and amplitude.

Typically, there are two different arrangements of conductors that are used to perform the write, erase, and sustain operations. The one common element throughout the arrangements is that the sustain and the address electrodes are spaced apart with the plasma-forming gas in between. Thus, at least one of the address or sustain electrodes is located within the path the radiation travels, when the plasma-forming gas ionizes, as it exits the plasma display. Consequently, transparent or semi-transparent conductive materials must be used, such as indium tin oxide (ITO), so that the electrodes do not interfere with the displayed image from the plasma display. Using ITO, however, has several disadvantages, for example, ITO is expensive and adds significant cost to the manufacturing process and ultimately the final plasma display.

The first arrangement uses two orthogonally crossed conductors, one addressing conductor and one sustaining conductor. In a gas panel of this type, the sustain waveform is applied across all the addressing conductors and sustain conductors so that the gas panel maintains a previously written pattern of light emitting pixels. For a conventional write operation, a suitable write voltage pulse is added to the sustain voltage waveform so that the combination of the write pulse and the sustain pulse produces ionization. In order to write an individual pixel independently, each of the addressing and sustain conductors has an individual selection circuit. Thus, applying a sustain waveform across all the addressing and sustain conductors, but applying a write pulse across only one addressing and one sustain conductor will produce a write operation in only the one pixel at the intersection of the selected addressing and sustain conductors.

The second arrangement uses three conductors. In panels of this type, called coplanar sustaining panels, each pixel is formed at the intersection of three conductors, one addressing conductor and two parallel sustaining conductors. In this arrangement, the addressing conductor orthogonally crosses the two parallel sustaining conductors. With this type of panel, the sustain function is performed between the two parallel sustaining conductors and the addressing is done by the generation of discharges between the addressing conductor and one of the two parallel sustaining conductors.

The sustaining conductors are of two types, addressing-sustaining conductors and solely sustaining conductors. The function of the addressing-sustaining conductors is twofold: to achieve a sustaining discharge in cooperation with the solely sustaining conductors; and to fulfill an addressing role. Consequently, the addressing-sustaining conductors are individually selectable so that an addressing waveform may be applied to any one or more addressing-sustaining conductors. The solely sustaining conductors, on the other hand, are typically connected in such a way that a sustaining waveform can be simultaneously applied to all of the solely sustaining conductors so that they can be carried to the same potential in the same instant.

Numerous types of plasma panel display devices have been constructed with a variety of methods for enclosing a plasma forming gas between sets of electrodes. In one type of plasma display panel, parallel plates of glass with wire electrodes on the surfaces thereof are spaced uniformly apart and sealed together at the outer edges with the plasma forming gas filling the cavity formed between the parallel plates. Although widely used, this type of open display structure has various disadvantages. The sealing of the outer edges of the parallel plates and the introduction of the plasma forming gas are both expensive and time-consuming processes, resulting in a costly end product. In addition, it is particularly difficult to achieve a good seal at the sites where the electrodes are fed through the ends of the parallel plates. This can result in gas leakage and a shortened product lifecycle. Another disadvantage is that individual pixels are not segregated within the parallel plates. As a result, gas ionization activity in a selected pixel during a write operation may spill over to adjacent pixels, thereby raising the undesirable prospect of possibly igniting adjacent pixels. Even if adjacent pixels are not ignited, the ionization activity can change the turn-on and turn-off characteristics of the nearby pixels.

In another type of known plasma display, individual pixels are mechanically isolated either by forming trenches in one of the parallel plates or by adding a perforated insulating layer sandwiched between the parallel plates. These mechanically isolated pixels, however, are not completely enclosed or isolated from one another because there is a need for the free passage of the plasma forming gas between the pixels to assure uniform gas pressure throughout the panel. While this type of display structure decreases spill over, spill over is still possible because the pixels are not in total electrical isolation from one another. In addition, in this type of display panel it is difficult to properly align the electrodes and the gas chambers, which may cause pixels to misfire. As with the open display structure, it is also difficult to get a good seal at the plate edges. Furthermore, it is expensive and time consuming to introduce the plasma producing gas and seal the outer edges of the parallel plates.

In yet another type of known plasma display, individual pixels are also mechanically isolated between parallel plates. In this type of display, the plasma forming gas is contained in transparent spheres formed of a closed transparent shell. Various methods have been used to contain the gas filled spheres between the parallel plates. In one method, spheres of varying sizes are tightly bunched and randomly distributed throughout a single layer, and sandwiched between the parallel plates. In a second method, spheres are embedded in a sheet of transparent dielectric material and that material is then sandwiched between the parallel plates. In a third method, a perforated sheet of electrically nonconductive material is sandwiched between the parallel plates with the gas filled spheres distributed in the perforations.

While each of the types of displays discussed above are based on different design concepts, the manufacturing approach used in their fabrication is generally the same. Conventionally, a batch fabrication process is used to manufacture these types of plasma panels. As is well known in the art, in a batch process individual component parts are fabricated separately, often in different facilities and by different manufacturers, and then brought together for final assembly where individual plasma panels are created one at a time. Batch processing has numerous shortcomings, such as, for example, the length of time necessary to produce a finished product. Long cycle times increase product cost and are undesirable for numerous additional reasons known in the art. For example, a sizeable quantity of substandard, defective, or useless fully or partially completed plasma panels may be produced during the period between detection of a defect or failure in one of the components and an effective correction of the defect or failure.

This is especially true of the first two types of displays discussed above; the first having no mechanical isolation of individual pixels, and the second with individual pixels mechanically isolated either by trenches formed in one parallel plate or by a perforated insulating layer sandwiched between two parallel plates. Due to the fact that plasma-forming gas is not isolated at the individual pixel/subpixel level, the fabrication process precludes the majority of individual component parts from being tested until the final display is assembled. Consequently, the display can only be tested after the two parallel plates are sealed together and the plasma-forming gas is filled inside the cavity between the two plates. If post production testing shows that any number of potential problems have occurred, (e.g. poor luminescence or no luminescence at specific pixels/subpixels) the entire display is discarded.

BRIEF SUMMARY OF THE INVENTION

Preferred embodiments of the present invention provide a light-emitting panel that may be used as a large-area radiation source, for energy modulation, for particle detection and as a flat-panel display. Gas-plasma panels are preferred for these applications due to their unique characteristics.

In one form, the light-emitting panel may be used as a large area radiation source. By configuring the light-emitting panel to emit ultraviolet (UV) light, the panel has application for curing, painting, and sterilization. With the addition of a white phosphor coating to convert the UV light to visible white light, the panel also has application as an illumination source.

In addition, the light-emitting panel may be used as a plasma-switched phase array by configuring the panel in at least one embodiment in a microwave transmission mode. The panel is configured in such a way that during ionization the plasma-forming gas creates a localized index of refraction change for the microwaves (although other wavelengths of light would work). The microwave beam from the panel can then be steered or directed in any desirable pattern by introducing at a localized area a phase shift and/or directing the microwaves out of a specific aperture in the panel Additionally, the light-emitting panel may be used for particle/photon detection. In this embodiment, the light-emitting panel is subjected to a potential that is just slightly below the write voltage required for ionization. When the device is subjected to outside energy at a specific position or location in the panel, that additional energy causes the plasma forming gas in the specific area to ionize, thereby providing a means of detecting outside energy.

Further, the light-emitting panel may be used in flat-panel displays. These displays can be manufactured very thin and lightweight, when compared to similar sized cathode ray tube (CRTs), making them ideally suited for home, office, theaters and billboards. In addition, these displays can be manufactured in large sizes and with sufficient resolution to accommodate high-definition television (HDTV). Gas-plasma panels do not suffer from electromagnetic distortions and are, therefore, suitable for applications strongly affected by magnetic fields, such as military applications, radar systems, railway stations and other underground systems.

According to one general embodiment of the present invention, a light-emitting panel is made from two substrates, wherein one of the substrates includes a plurality of sockets and wherein at least two electrodes are disposed. At least partially disposed in each socket is a micro-component, although more than one micro-component may be disposed therein. Each micro-component includes a shell at least partially filled with a gas or gas mixture capable of ionization. When a large enough voltage is applied across the micro-component the gas or gas mixture ionizes forming plasma and emitting radiation.

In an embodiment of the present invention, the plurality of sockets include a cavity that is patterned in the first substrate and at least two electrodes adhered to the first substrate, the second substrate or any combination thereof.

In another embodiment, the plurality of sockets include a cavity that is patterned in the first substrate and at least two electrodes that are arranged so that voltage supplied to the electrodes causes at least one micro-component to emit radiation throughout the field of view of the light-emitting panel without the radiation crossing the electrodes.

In another embodiment, a first substrate comprises a plurality of material layers and a socket is formed by selectively removing a portion of the plurality of material layers to form a cavity and disposing at least one electrode on or within the material layers.

In another embodiment, a socket includes a cavity patterned in a first substrate, a plurality of material layers disposed on the first substrate so that the plurality of material layers conform to the shape of the socket and at least one electrode disposed within the material layers.

In another embodiment, a plurality of material layers, each including an aperture, are disposed on a substrate. In this embodiment, the material layers are disposed so that the apertures are aligned, thereby forming a cavity.

Other embodiments are directed to methods for energizing a micro-component in a light-emitting display using the socket configurations described above with voltage provided to at least two electrodes causing at least one micro-component at least partially disposed in the cavity of a socket to emit radiation.

Other features, advantages, and embodiments of the invention are set forth in part in the description that follows, and in part, will be obvious from this description, or may be learned from the practice of the invention.

BRIEF DESCRIPTION OF THE DRAWINGS

The foregoing and other objects, features and advantages of this invention will become more apparent by reference to the following detailed description of the invention taken in conjunction with the accompanying drawings, wherein.

DETAILED DESCRIPTION OF THE PREFERRED EMBODIMENTS OF THE INVENTION

As embodied and broadly described herein, the preferred embodiments of the present invention are directed to a novel light-emitting panel. In particular, preferred embodiments are directed to light-emitting panels and to a web fabrication process for manufacturing light-emitting panels.

Figure 1:
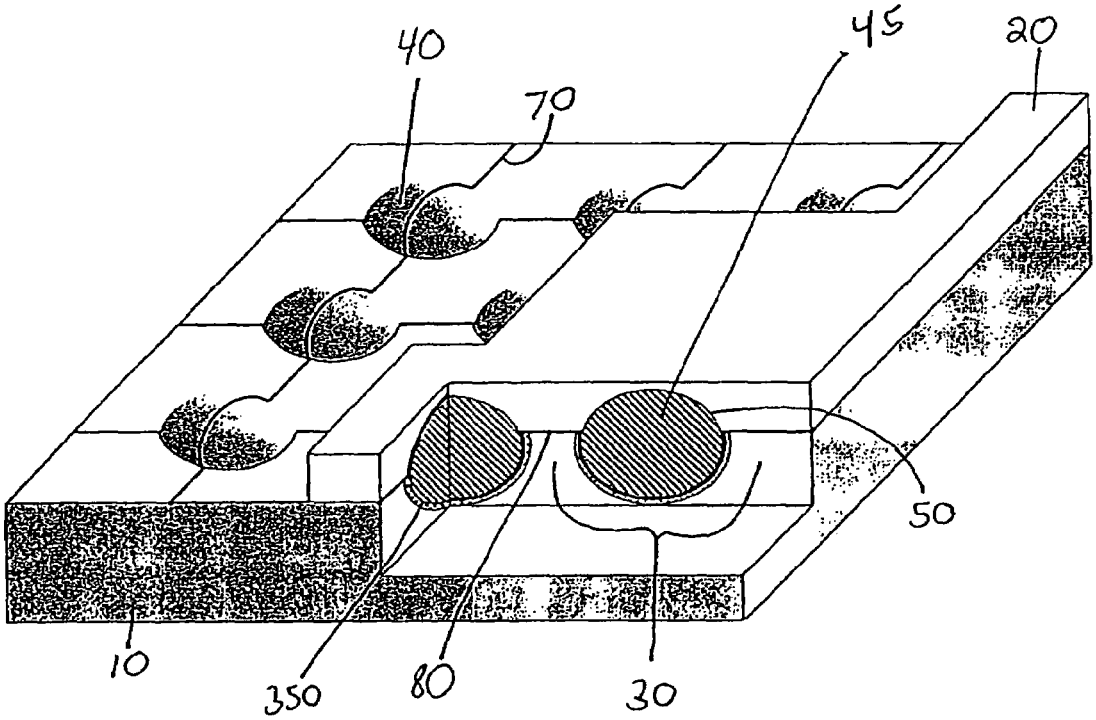
FIG. 1 depicts a portion of a light-emitting panel showing the basic socket structure of a socket formed from patterning a substrate, as disclosed in an embodiment of the present invention.
Figure 1A:
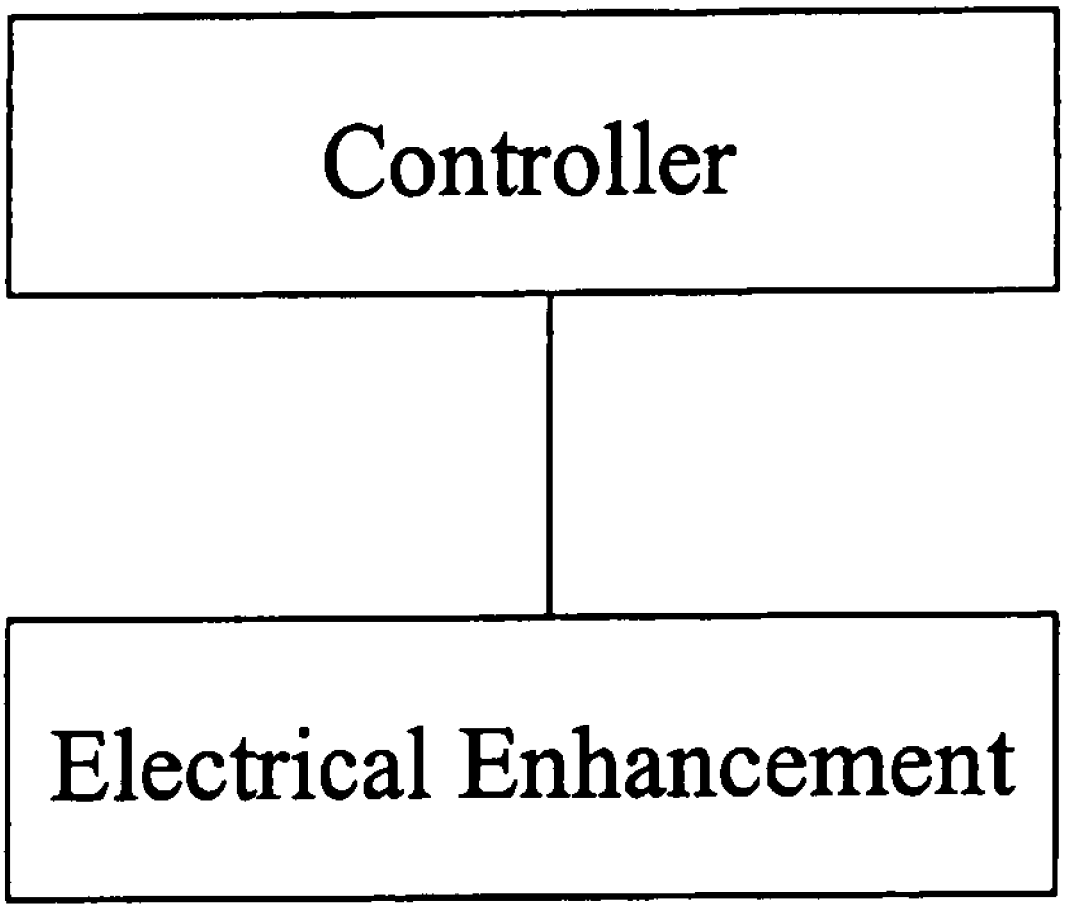
FIG. 1A depicts a controller connected to an electrical enhancement according to an embodiment of the present invention.
Figure 2:
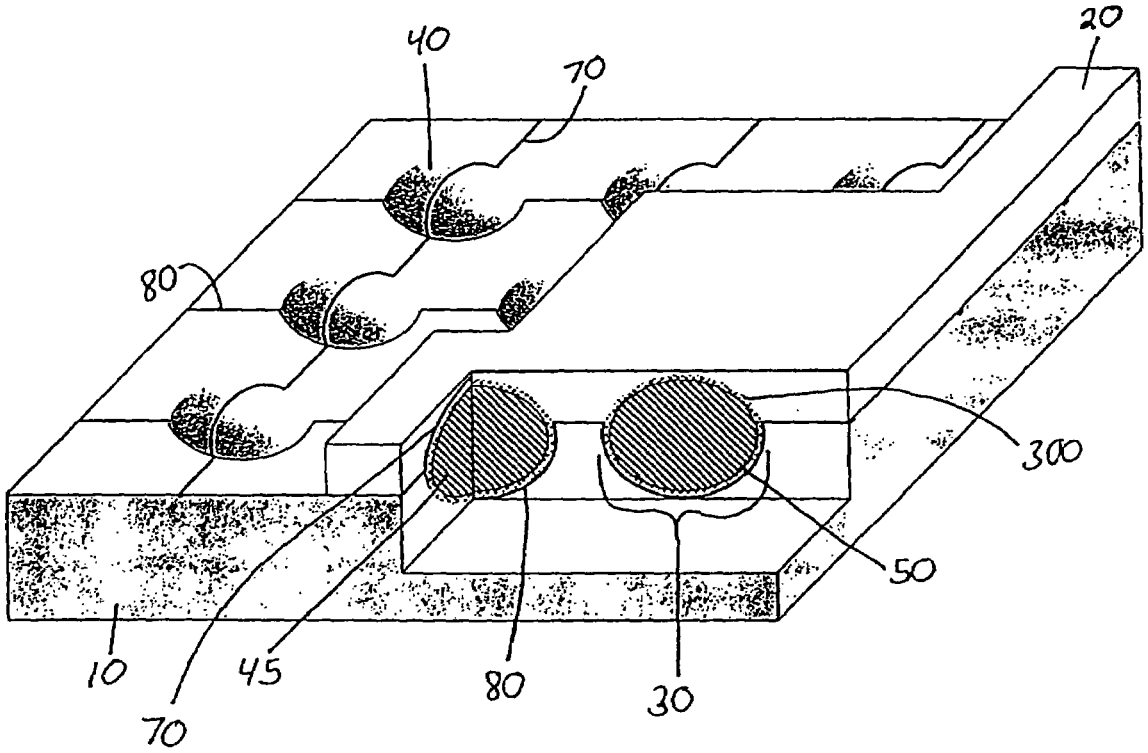
FIG. 2 depicts a portion of a light-emitting panel showing the basic socket structure of a socket formed from patterning a substrate, as disclosed in another embodiment of the present invention.
Figure 3A:
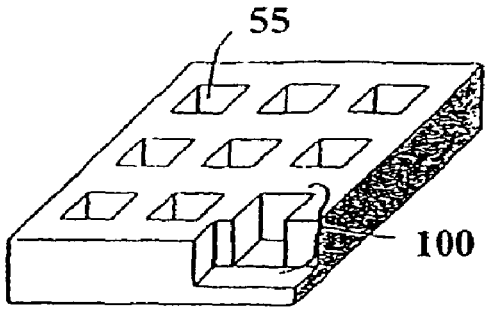
FIG. 3A shows an example of a cavity that has a cube shape.
Figure 3B:
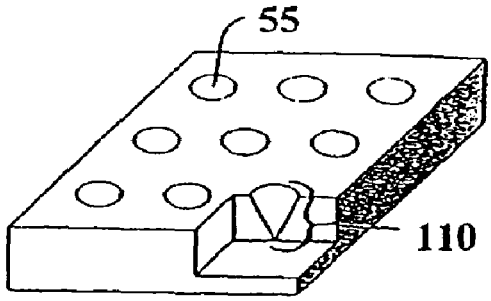
FIG. 3B shows an example of a cavity that has a cone shape.
Figure 3C:
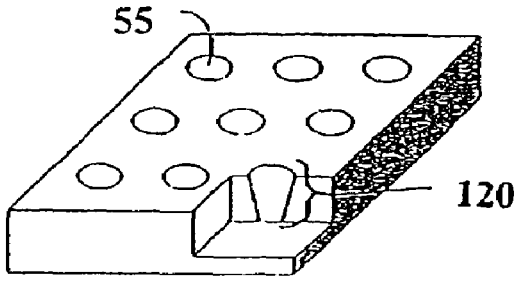
FIG. 3C shows an example of a cavity that has a conical frustum shape.
Figure 3D:
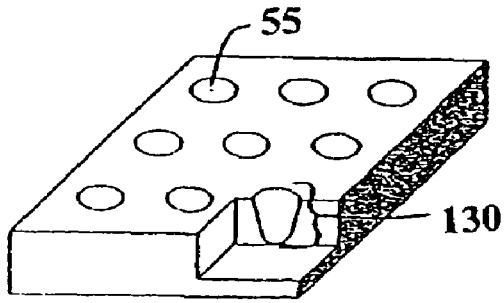
FIG. 3D shows an example of a cavity that has a paraboloid shape.
Figure 3E:
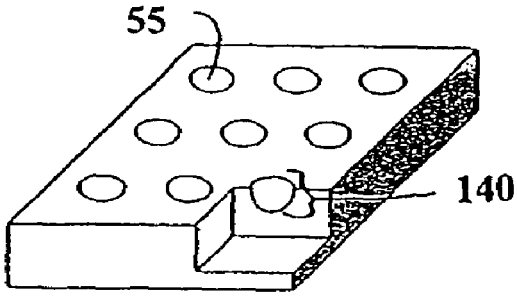
FIG. 3E shows an example of a cavity that has a spherical shape.
Figure 3F:
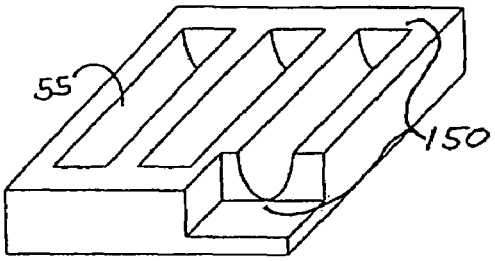
FIG. 3F shows an example of a cavity that has a cylindrical shape.
Figure 3G:
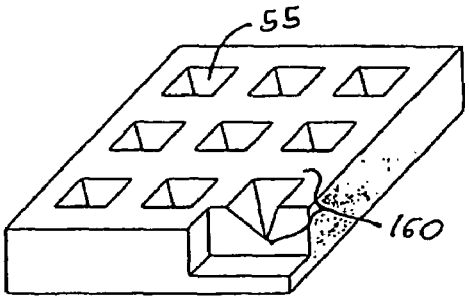
FIG. 3G shows an example of a cavity that has a pyramid shape.
Figure 3H:
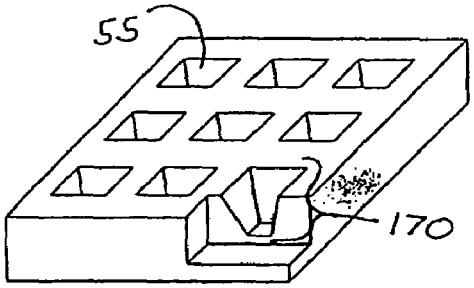
FIG. 3H shows an example of a cavity that has a pyramidal frustum shape.
Figure 3I:
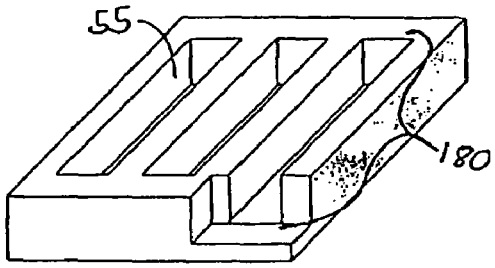
FIG. 3I shows an example of a cavity that has a parallelepiped shape.
Figure 3J:
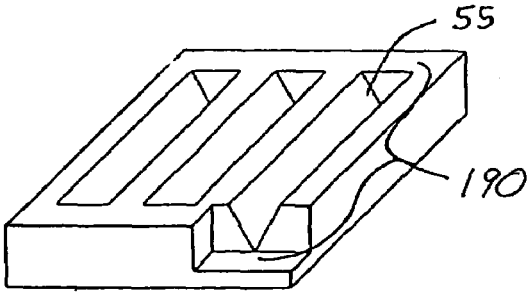
FIG. 3J shows an example of a cavity that has a prism shape.

FIGS. 1 and 2 show two embodiments of the present invention wherein a light-emitting panel includes a first substrate 10 and a second substrate 20. The first substrate 10 may be made from silicates, polypropylene, quartz, glass, any polymeric-based material or any material or combination of materials known to one skilled in the art. Similarly, second substrate 20 may be made from silicates, polypropylene, quartz, glass, any polymeric-based material or any material or combination of materials known to one skilled in the art. First substrate 10 and second substrate 20 may both be made from the same material or each of a different material. Additionally, the first and second substrate may be made of a material that dissipates heat from the light-emitting panel. In a preferred embodiment, each substrate is made from a material that is mechanically flexible.

The first substrate 10 includes a plurality of sockets 30. The sockets 30 may be disposed in any pattern, having uniform or non-uniform spacing between adjacent sockets. Patterns may include, but are not limited to, alphanumeric characters, symbols, icons, or pictures. Preferably, the sockets 30 are disposed in the first substrate 10 so that the distance between adjacent sockets 30 is approximately equal. Sockets 30 may also be disposed in groups such that the distance between one group of sockets and another group of sockets is approximately equal. This latter approach may be particularly relevant in color light-emitting panels, where each socket in each group of sockets may represent red, green and blue, respectively.

At least partially disposed in each socket 30 is at least one micro-component 40. Multiple micro-components may be disposed in a socket to provide increased luminosity and enhanced radiation transport efficiency. In a color light-emitting panel according to one embodiment of the present invention, a single socket supports three micro-components configured to emit red, green, and blue light, respectively. The micro-components 40 may be of any shape, including, but not limited to, spherical, cylindrical, and aspherical. In addition, it is contemplated that a micro-component 40 includes a micro-component placed or formed inside another structure, such as placing a spherical micro-component inside a cylindrical-shaped structure. In a color light-emitting panel according to an embodiment of the present invention, each cylindrical-shaped structure holds micro-components configured to emit a single color of visible light or multiple colors arranged red, green, blue, or in some other suitable color arrangement.

In its most basic form, each micro-component 40 includes a shell 50 filled with a plasma-forming gas or gas mixture 45. Any suitable gas or gas mixture 45 capable of ionization may be used as the plasma-forming gas, including, but not limited to, krypton, xenon, argon, neon, oxygen, helium, mercury, and mixtures thereof. In fact, any noble gas could be used as the plasma-forming gas, including, but not limited to, noble gases mixed with cesium or mercury. One skilled in the art would recognize other gasses or gas mixtures that could also be used. While a plasma-forming gas or gas mixture 45 is used in a preferred embodiment, any other material capable of providing luminescence is also contemplated, such as an electro-luminescent material, organic light-emitting diodes (OLEDs), or an electrophoretic material.

There are a variety of coatings 300 and dopants that may be added to a micro-component 40 that also influence the performance and characteristics of the light-emitting panel. The coatings 300 may be applied to the outside or inside of the shell 50, and may either partially or fully coat the shell 50. Alternatively, or in combination with the coatings and dopants that may be added to a micro-component 40, a variety of coatings 350 may be disposed on the inside of a socket 30. These coatings 350 include, but are not limited to, coatings used to convert UV light to visible light, coatings used as reflecting filters, and coatings used as band-gap filters.

A cavity 55 formed within and/or on the first substrate 10 provides the basic socket 30 structure. The cavity 55 may be any shape and size. As depicted in FIGS. 3A–3J, the shape of the cavity 55 may include, but is not limited to, a cube 100, a cone 110, a conical frustum 120, a paraboloid 130, spherical 140, cylindrical 150, a pyramid 160, a pyramidal frustum 170, a parallelepiped 180, or a prism 190.

Figure 4:
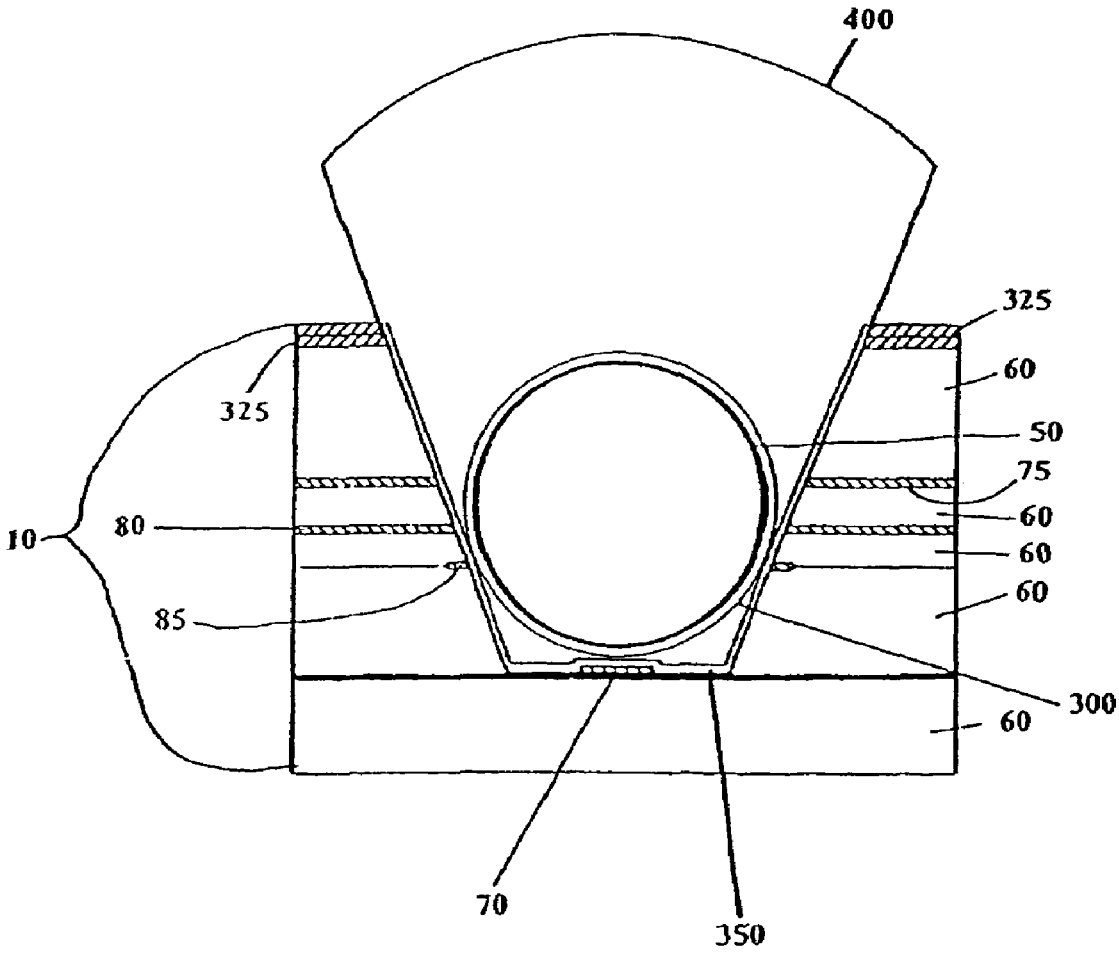
FIG. 4 shows the socket structure from a light-emitting panel of an embodiment of the present invention with a narrower field of view.
Figure 5:
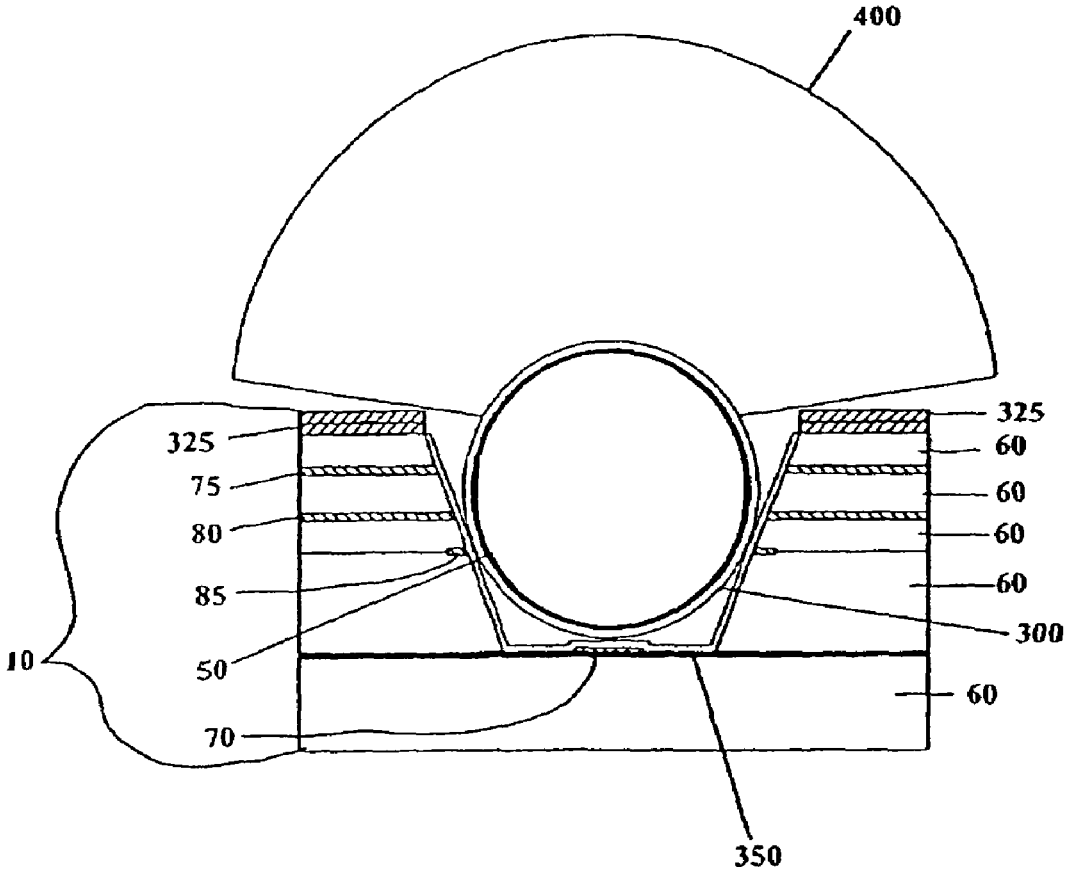
FIG. 5 shows the socket structure from a light-emitting panel of an embodiment of the present invention with a wider field of view.

The size and shape of the socket 30 influence the performance and characteristics of the light-emitting panel and are selected to optimize the panel's efficiency of operation. In addition, socket geometry may be selected based on the shape and size of the micro-component to optimize the surface contact between the micro-component and the socket and/or to ensure connectivity of the micro-component and any electrodes disposed within the socket. Further, the size and shape of the sockets 30 may be chosen to optimize photon generation and provide increased luminosity and radiation transport efficiency. As shown by example in FIGS. 4 and 5, the size and shape may be chosen to provide a field of view 400 with a specific angle θ, such that a micro-component 40 disposed in a deep socket 30 may provide more collimated light and hence a narrower viewing angle θ (FIG. 4), while a micro-component 40 disposed in a shallow socket 30 may provide a wider viewing angle θ (FIG. 5). That is to say, the cavity may be sized, for example, so that its depth subsumes a micro-component deposited in a socket, or it may be made shallow so that a micro-component is only partially disposed within a socket.

In an embodiment for a light-emitting panel, a cavity 55 is formed, or patterned, in a substrate 10 to create a basic socket shape. The cavity may be formed in any suitable shape and size by any combination of physically, mechanically, thermally, electrically, optically, or chemically deforming the substrate. Disposed proximate to, and/or in, each socket may be a variety of enhancement materials 325. The enhancement materials 325 include, but are not limited to, anti-glare coatings, touch sensitive surfaces, contrast enhancement coatings, protective coatings, transistors, integrated-circuits, semiconductor devices, inductors, capacitors, resistors, control electronics, drive electronics, diodes, pulse-forming networks, pulse compressors, pulse transformers, and tuned-circuits.

In another embodiment of the present invention for a light-emitting panel, a socket 30 is formed by disposing a plurality of material layers 60 to form a first substrate 10, disposing at least one electrode either on or within the material layers, and selectively removing a portion of the material layers 60 to create a cavity. The material layers 60 include any combination, in whole or in part, of dielectric materials, metals, and enhancement materials 325. The enhancement materials 325 include, but are not limited to, anti-glare coatings, touch sensitive surfaces, contrast enhancement coatings, protective coatings, transistors, integrated-circuits, semiconductor devices, inductors, capacitors, resistors, control electronics, drive electronics, diodes, pulse-forming networks, pulse compressors, pulse transformers, and tuned-circuits. The placement of the material layers 60 may be accomplished by any transfer process, photolithography, sputtering, laser deposition, chemical deposition, vapor deposition, or deposition using ink jet technology. One of general skill in the art will recognize other appropriate methods of disposing a plurality of material layers. The cavity 55 may be formed in the material layers 60 by a variety of methods including, but not limited to, wet or dry etching, photolithography, laser heat treatment, thermal form, mechanical punch, embossing, stamping-out, drilling, electroforming or by dimpling.

In another embodiment of the present invention for a light-emitting panel, a socket 30 is formed by patterning a cavity 55 in a first substrate 10, disposing a plurality of material layers 65 on the first substrate 10 so that the material layers 65 conform to the cavity 55, and disposing at least one electrode on the first substrate 10, within the material layers 65, or any combination thereof. The cavity may be formed in any suitable shape and size by any combination of physically, mechanically, thermally, electrically, optically, or chemically deforming the substrate. The material layers 60 include any combination, in whole or in part, of dielectric materials, metals, and enhancement materials 325. The enhancement materials 325 include, but are not limited to, anti-glare coatings, touch sensitive surfaces, contrast enhancement coatings, protective coatings, transistors, integrated-circuits, semiconductor devices, inductors, capacitors, resistors, control electronics, drive electronics, diodes, pulse-forming networks, pulse compressors, pulse transformers, and tuned-circuits. The placement of the material layers 60 may be accomplished by any transfer process, photolithography, sputtering, laser deposition, chemical deposition, vapor deposition, or deposition using ink jet technology. One of general skill in the art will recognize other appropriate methods of disposing a plurality of material layers on a substrate.

In another embodiment of the present invention for a method of making a light-emitting panel including a plurality of sockets, a socket 30 is formed by disposing a plurality of material layers 66 on a first substrate 10 and disposing at least one electrode on the first substrate 10, within the material layers 66, or any combination thereof. Each of the material layers includes a preformed aperture 56 that extends through the entire material layer. The apertures may be of the same size or may be of different sizes. The plurality of material layers 66 are disposed on the first substrate with the apertures in alignment thereby forming a cavity 55. The material layers 66 include any combination, in whole or in part, of dielectric materials, metals, and enhancement materials 325. The enhancement materials 325 include, but are not limited to, anti-glare coatings, touch sensitive surfaces, contrast enhancement coatings, protective coatings, transistors, integrated-circuits, semiconductor devices, inductors, capacitors, resistors, diodes, control electronics, drive electronics, pulse-forming networks, pulse compressors, pulse transformers, and tuned-circuits. The placement of the material layers 66 may be accomplished by any transfer process, photolithography, sputtering, laser deposition, chemical deposition, vapor deposition, or deposition using ink jet technology. One of general skill in the art will recognize other appropriate methods of disposing a plurality of material layers on a substrate.

In the above embodiments describing four different methods of making a socket in a light-emitting panel, disposed in, or proximate to, each socket may be at least one enhancement material. As stated above the enhancement material 325 may include, but is not limited to, antiglare coatings, touch sensitive surfaces, contrast enhancement coatings, protective coatings, transistors, integrated-circuits, semiconductor devices, inductors, capacitors, resistors, control electronics, drive electronics, diodes, pulse-forming networks, pulse compressors, pulse transformers, and tuned-circuits. In a preferred embodiment of the present invention the enhancement materials may be disposed in, or proximate to each socket by any transfer process, photolithography, sputtering, laser deposition, chemical deposition, vapor deposition, deposition using ink jet technology, or mechanical means. In another embodiment of the present invention, a method for making a light-emitting panel includes disposing at least one electrical enhancement (e.g. the transistors, integrated-circuits, semiconductor devices, inductors, capacitors, resistors, control electronics, drive electronics, diodes, pulse-forming networks, pulse compressors, pulse transformers, and tuned-circuits), in, or proximate to, each socket by suspending the at least one electrical enhancement in a liquid and flowing the liquid across the first substrate. As the liquid flows across the substrate the at least one electrical enhancement will settle in each socket. It is contemplated that other substances or means may be use to move the electrical enhancements across the substrate. One such means may include, but is not limited to, using air to move the electrical enhancements across the substrate. In another embodiment of the present invention the socket is of a corresponding shape to the at least one electrical enhancement such that the at least one electrical enhancement self-aligns with the socket.

The electrical enhancements may be used in a light-emitting panel for a number of purposes including, but not limited to, lowering the voltage necessary to ionize the plasmaforming gas in a micro-component, lowering the voltage required to sustain/erase the ionization charge in a micro-component, increasing the luminosity and/or radiation transport efficiency of a micro-component, and augmenting the frequency at which a micro-component is lit. In addition, the electrical enhancements may be used in conjunction with the light-emitting panel driving circuitry to alter the power requirements necessary to drive the light-emitting panel. For example, a tuned-circuit may be used in conjunction with the driving circuitry to allow a DC power source to power an AC-type light-emitting panel. In an embodiment of the present invention, a controller is provided that is connected to the electrical enhancements and capable of controlling their operation. Having the ability to individual control the electrical enhancements at each pixel/subpixel provides a means by which the characteristics of individual micro-components may be altered/corrected after fabrication of the light-emitting panel. These characteristics include, but are not limited to, luminosity and the frequency at which a micro-component is lit. One skilled in the art will recognize other uses for electrical enhancements disposed in, or proximate to, each socket in a light-emitting panel.

The electrical potential necessary to energize a micro-component 40 is supplied via at least two electrodes. The electrodes may be disposed in the light-emitting panel using any technique known to one skilled in the art including, but not limited to, any transfer process, photolithography, sputtering, laser deposition, chemical deposition, vapor deposition, deposition using ink jet technology, or mechanical means. In a general embodiment of the present invention, a light-emitting panel includes a plurality of electrodes, wherein at least two electrodes are adhered to the first substrate, the second substrate or any combination thereof and wherein the electrodes are arranged so that voltage applied to the electrodes causes one or more micro-components to emit radiation. In another general embodiment, a light-emitting panel includes a plurality of electrodes, wherein at least two electrodes are arranged so that voltage supplied to the electrodes cause one or more micro-components to emit radiation throughout the field of view of the light-emitting panel without crossing either of the electrodes.

In an embodiment where the sockets 30 each include a cavity patterned in the first substrate 10, at least two electrodes may be disposed on the first substrate 10, the second substrate 20, or any combination thereof. In an embodiment for a method of energizing a micro-component, the electrodes may be disposed either before the cavity is formed or after the cavity is formed. In exemplary embodiments as shown in FIGS. 1 and 2, a sustain electrode 70 is adhered on the second substrate 20 and an address electrode 80 is adhered on the first substrate 10. In a preferred embodiment, at least one electrode adhered to the first substrate 10 is at least partly disposed within the socket (FIGS. 1 and 2).

Figure 6A:
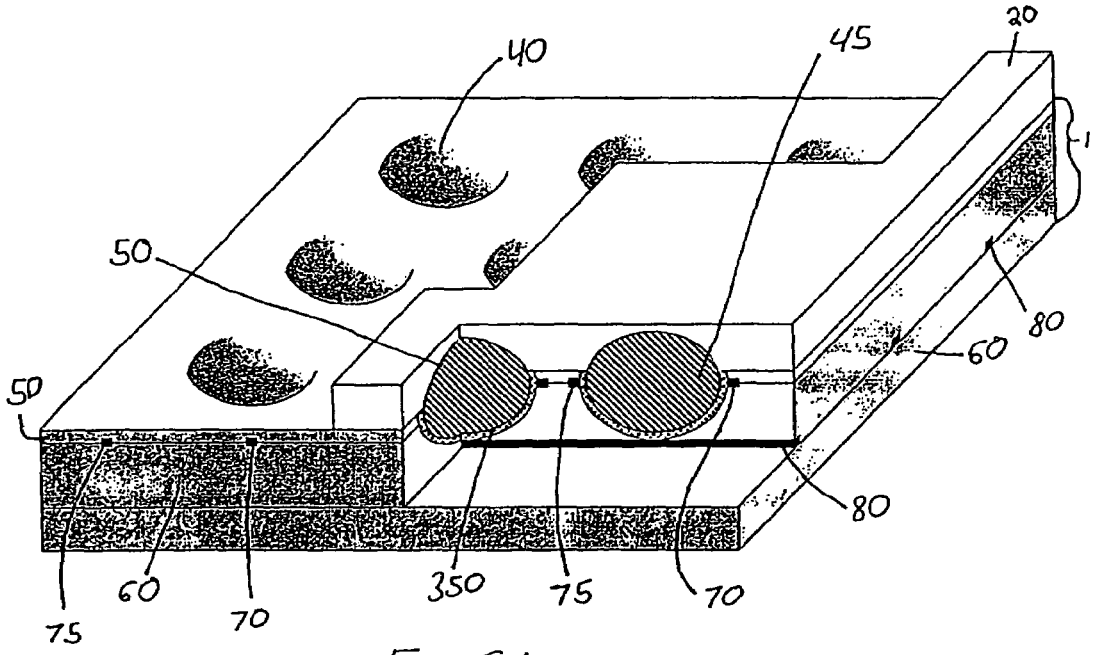
FIG. 6A depicts a portion of a light-emitting panel showing the basic socket structure of a socket formed from disposing a plurality of material layers and then selectively removing a portion of the material layers with the electrodes having a co-planar configuration.
Figure 6B:
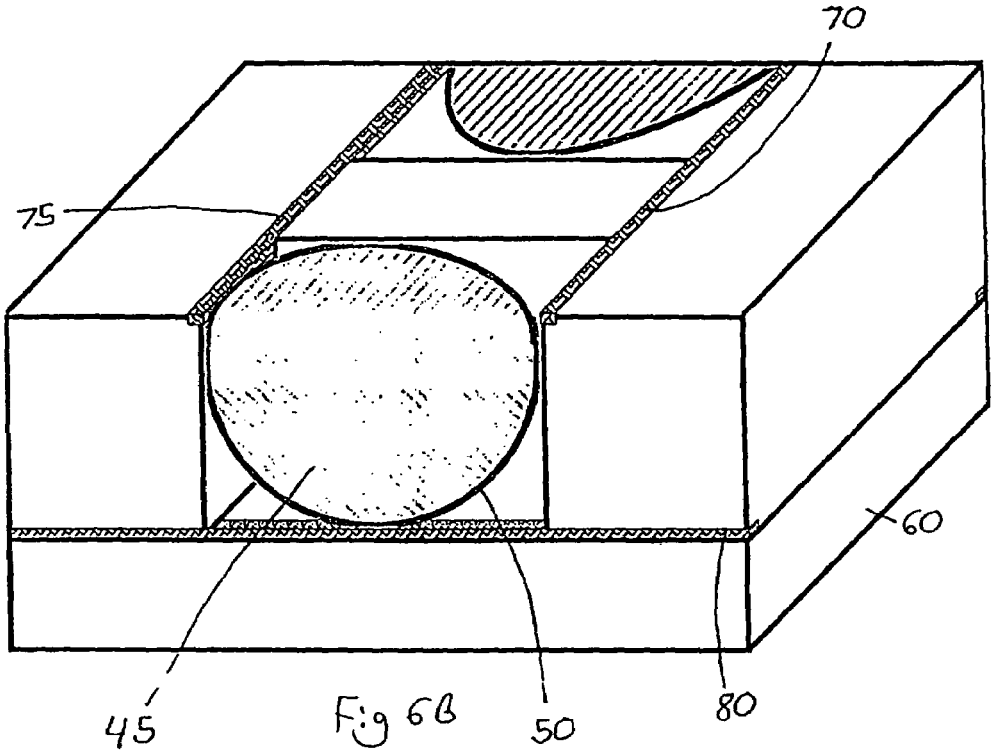
FIG. 6B is a cut-away of FIG. 6A showing in more detail the co-planar sustaining electrodes.
Figure 7A:
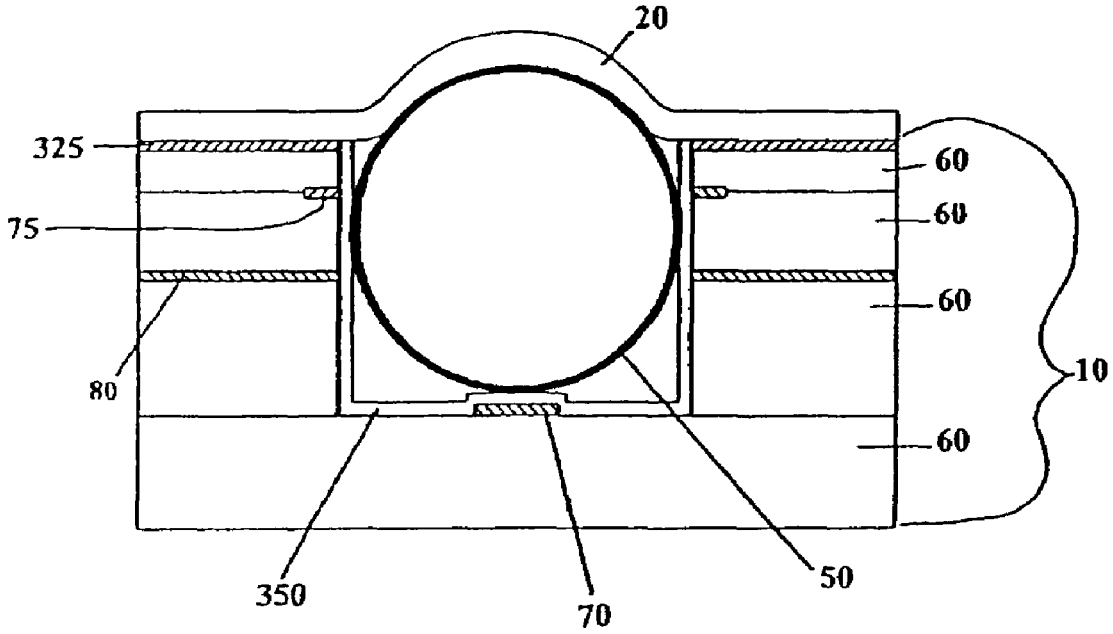
FIG. 7A depicts a portion of a light-emitting panel showing the basic socket structure of a socket formed from disposing a plurality of material layers and then selectively removing a portion of the material layers with the electrodes having a mid-plane configuration.
Figure 7B:
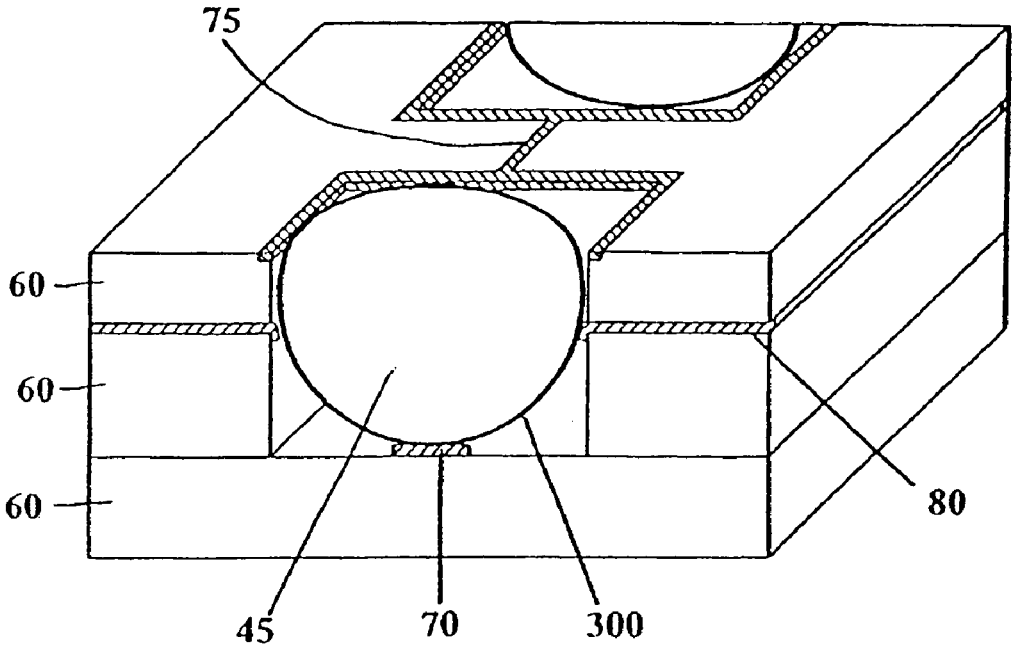
FIG. 7B is a cut-away of FIG. 7A showing in more detail the uppermost sustain electrode.
Figure 8:
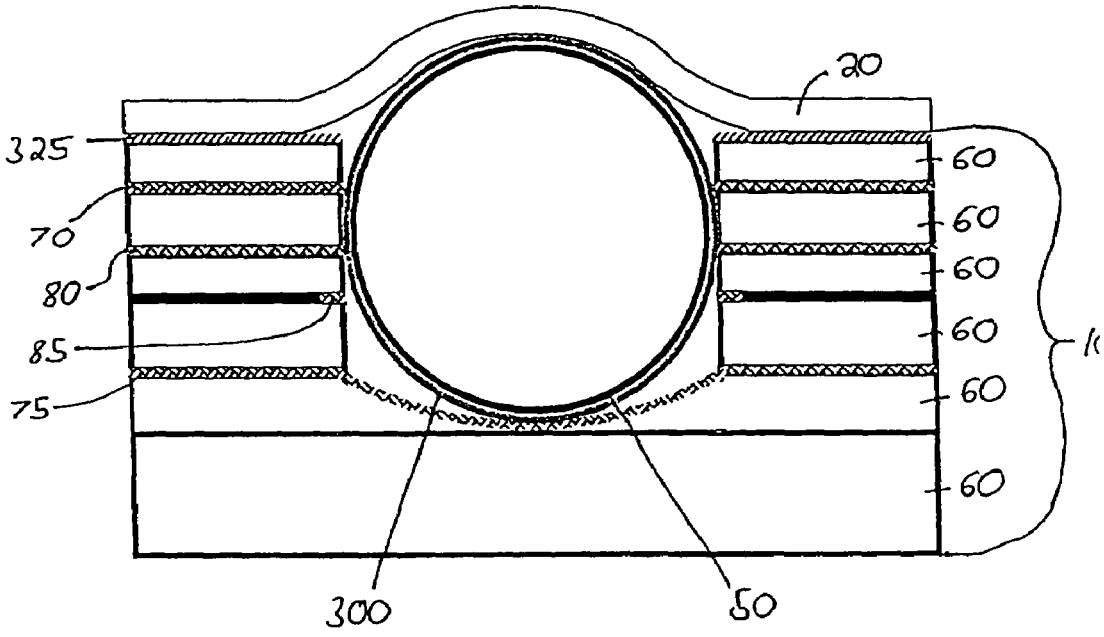
FIG. 8 depicts a portion of a light-emitting panel showing the basic socket structure of a socket formed from disposing a plurality of material layers and then selectively removing a portion of the material layers with the electrodes having an configuration with two sustain and two address electrodes, where the address electrodes are between the two sustain electrodes.

In an embodiment where the first substrate 10 includes a plurality of material layers 60 and the sockets 30 are formed within the material layers, at least two electrodes may be disposed on the first substrate 10, disposed within the material layers 60, disposed on the second substrate 20, or any combination thereof. In one embodiment, as shown in FIG. 6A, a first address electrode 80 is disposed within the material layers 60, a first sustain electrode 70 is disposed within the material layers 60, and a second sustain electrode 75 is disposed within the material layers 60, such that the first sustain electrode and the second sustain electrode are in a co-planar configuration. FIG. 6B is a cut-away of FIG. 6A showing the arrangement of the co-planar sustain electrodes 70 and 75. In another embodiment, as shown in FIG. 7A, a first sustain electrode 70 is disposed on the first substrate 10, a first address electrode 80 is disposed within the material layers 60, and a second sustain electrode 75 is disposed within the material layers 60, such that the first address electrode is located between the first sustain electrode and the second sustain electrode in a mid-plane configuration. FIG. 7B is a cut-away of FIG. 7A showing the first sustain electrode 70. In this mid-plane configuration, the sustain function will be performed by the two sustain electrodes much like in the co-planar configuration and the address function will be performed between at least one of the sustain electrodes and the address electrode. It is believed that energizing a micro-component with this arrangement of electrodes will produce increased luminosity. As seen in FIG. 8, in a preferred embodiment of the present invention, a first sustain electrode 70 is disposed within the material layers 60, a first address electrode 80 is disposed within the material layers 60, a second address electrode 85 is disposed within the material layers 60, and a second sustain electrode 75 is disposed within the material layers 60, such that the first address electrode and the second address electrode are located between the first sustain electrode and the second sustain electrode. This configuration completely separates the addressing function from the sustain electrodes. It is believed that this arrangement will provide a simpler and cheaper means of addressing, sustain and erasing, because complicated switching means will not be required since different voltage sources may be used for the sustain and address electrodes. It is also believed that by separating the sustain and address electrodes so different voltage sources may be used to provide the address and sustain functions, a lower or different type of voltage source may be used to provide the address or sustain functions.

Figure 9:
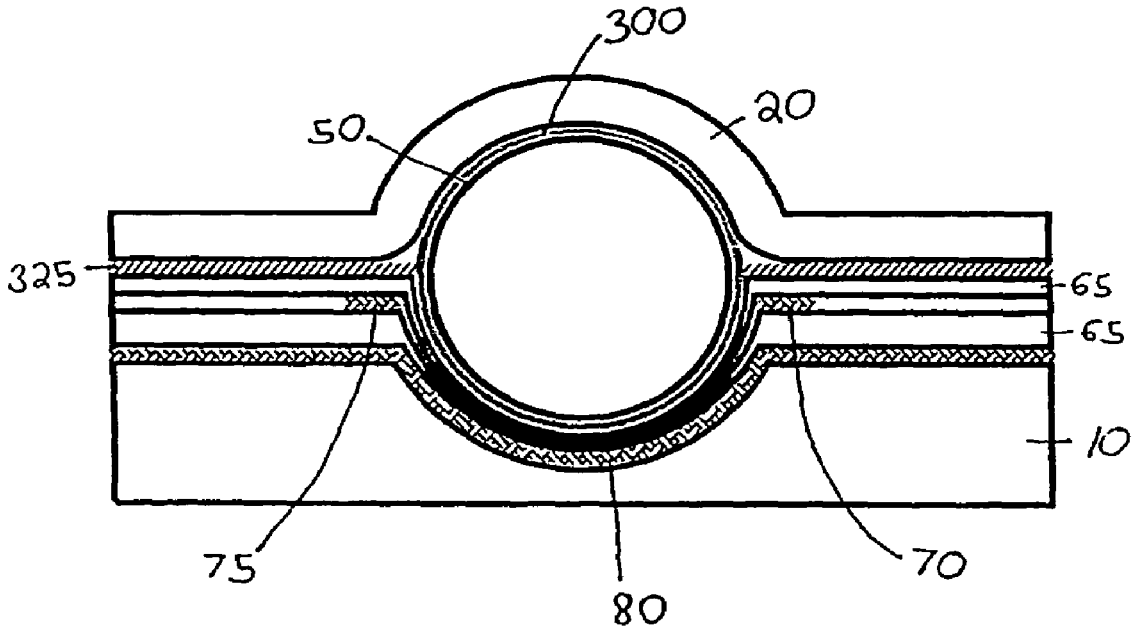
FIG. 9 depicts a portion of a light-emitting panel showing the basic socket structure of a socket formed from patterning a substrate and then disposing a plurality of material layers on the substrate so that the material layers conform to the shape of the cavity with the electrodes having a co-planar configuration.
Figure 10:
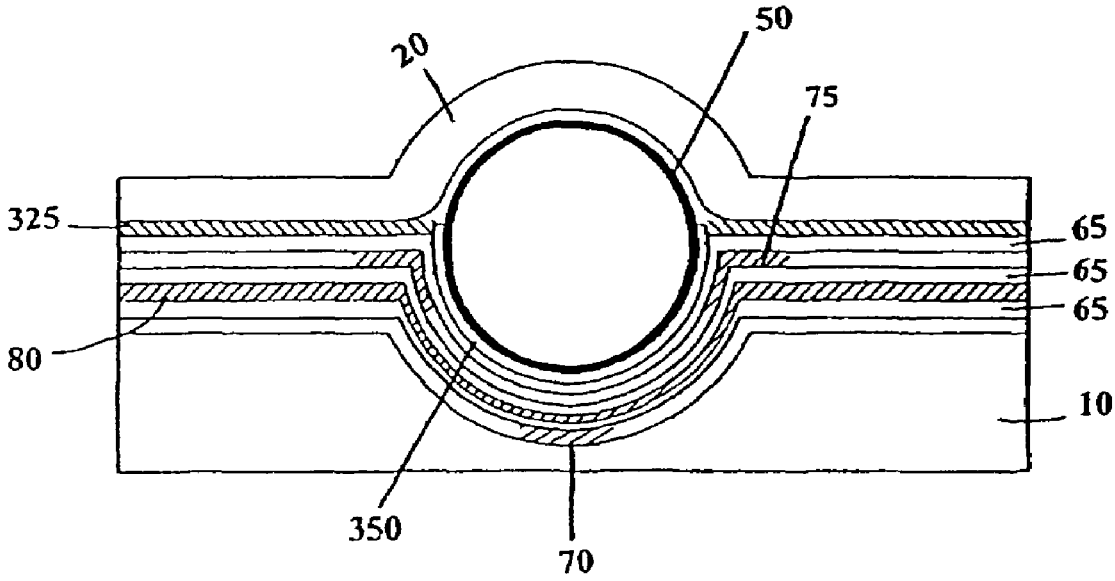
FIG. 10 depicts a portion of a light-emitting panel showing the basic socket structure of a socket formed from patterning a substrate and then disposing a plurality of material layers on the substrate so that the material layers conform to the shape of the cavity with the electrodes having a mid-plane configuration.
Figure 11:
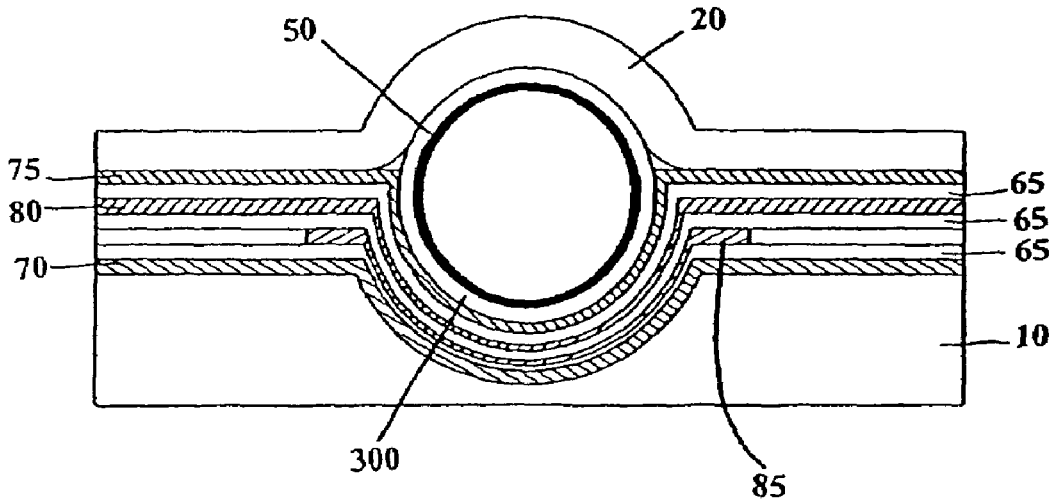
FIG. 11 depicts a portion of a light-emitting panel showing the basic socket structure of a socket formed from patterning a substrate and then disposing a plurality of material layers on the substrate so that the material layers conform to the shape of the cavity with the electrodes having an configuration with two sustain and two address electrodes, where the address electrodes are between the two sustain electrodes.

In an embodiment where a cavity 55 is patterned in the first substrate 10 and a plurality of material layers 65 are disposed on the first substrate 10 so that the material layers conform to the cavity 55, at least two electrodes may be disposed on the first substrate 10, at least partially disposed within the material layers 65, disposed on the second substrate 20, or any combination thereof. In an embodiment for a method of energizing a micro-component, electrodes formed on the first substrate may be disposed either before the cavity was patterned or after the cavity was patterned. In one embodiment, as shown in FIG. 9, a first address electrode 80 is disposed on the first substrate 10, a first sustain electrode 70 is disposed within the material layers 65, and a second sustain electrode 75 is disposed within the material layers 65, such that the first sustain electrode and the second sustain electrode are in a co-planar configuration. In another embodiment, as shown in FIG. 10, a first sustain electrode 70 is disposed on the first substrate 10, a first address electrode 80 is disposed within the material layers 65, and a second sustain electrode 75 is disposed within the material layers 65, such that the first address electrode is located between the first sustain electrode and the second sustain electrode in a mid-plane configuration. In this mid-plane configuration, the sustain function will be performed by the two sustain electrodes much like in the co-planar configuration and the address function will be performed between at least one of the sustain electrodes and the address electrode. It is believed that energizing a micro-component with this arrangement of electrodes will produce increased luminosity. As seen in FIG. 11, in a preferred embodiment of the present invention, a first sustain electrode 70 is disposed on the first substrate 10, a first address electrode 80 is disposed within the material layers 65, a second address electrode 85 is disposed within the material layers 65, and a second sustain electrode 75 is disposed within the material layers 65, such that the first address electrode and the second address electrode are located between the first sustain electrode and the second sustain electrode. This configuration completely separates the addressing function from the sustain electrodes. It is believed that this arrangement will provide a simpler and cheaper means of addressing, sustain and erasing, because complicated switching means will not be required since different voltage sources may be used for the sustain and address electrodes. It is also believed that by separating the sustain and address electrodes so different voltage sources may be used to provide the address and sustain functions a lower or different type of voltage source may be used to provide the address or sustain functions.

Figure 12:
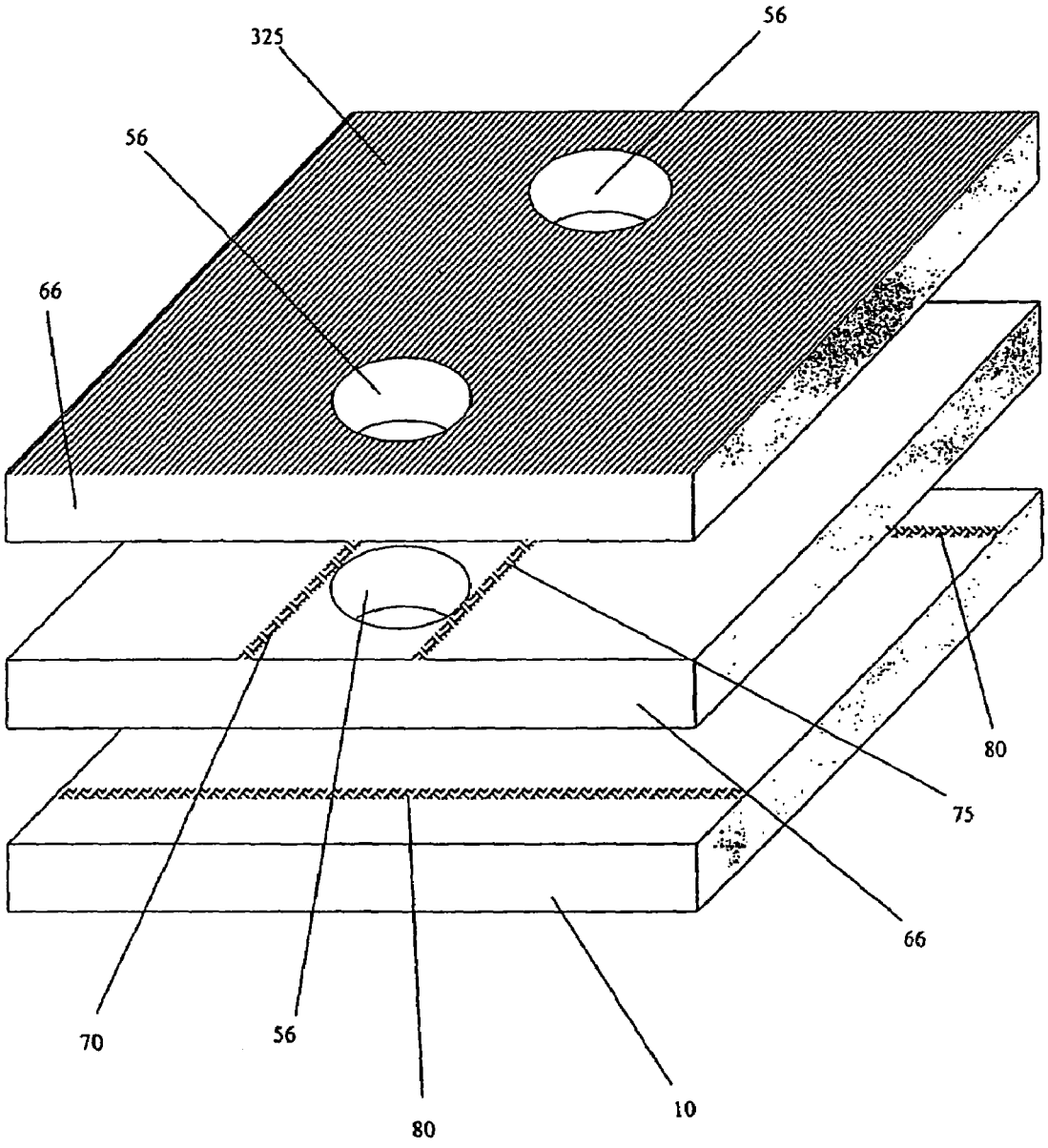
FIG. 12 shows an exploded view of a portion of a light-emitting panel showing the basic socket structure of a socket formed by disposing a plurality of material layers with aligned apertures on a substrate with the electrodes having a co-planar configuration.
Figure 13:
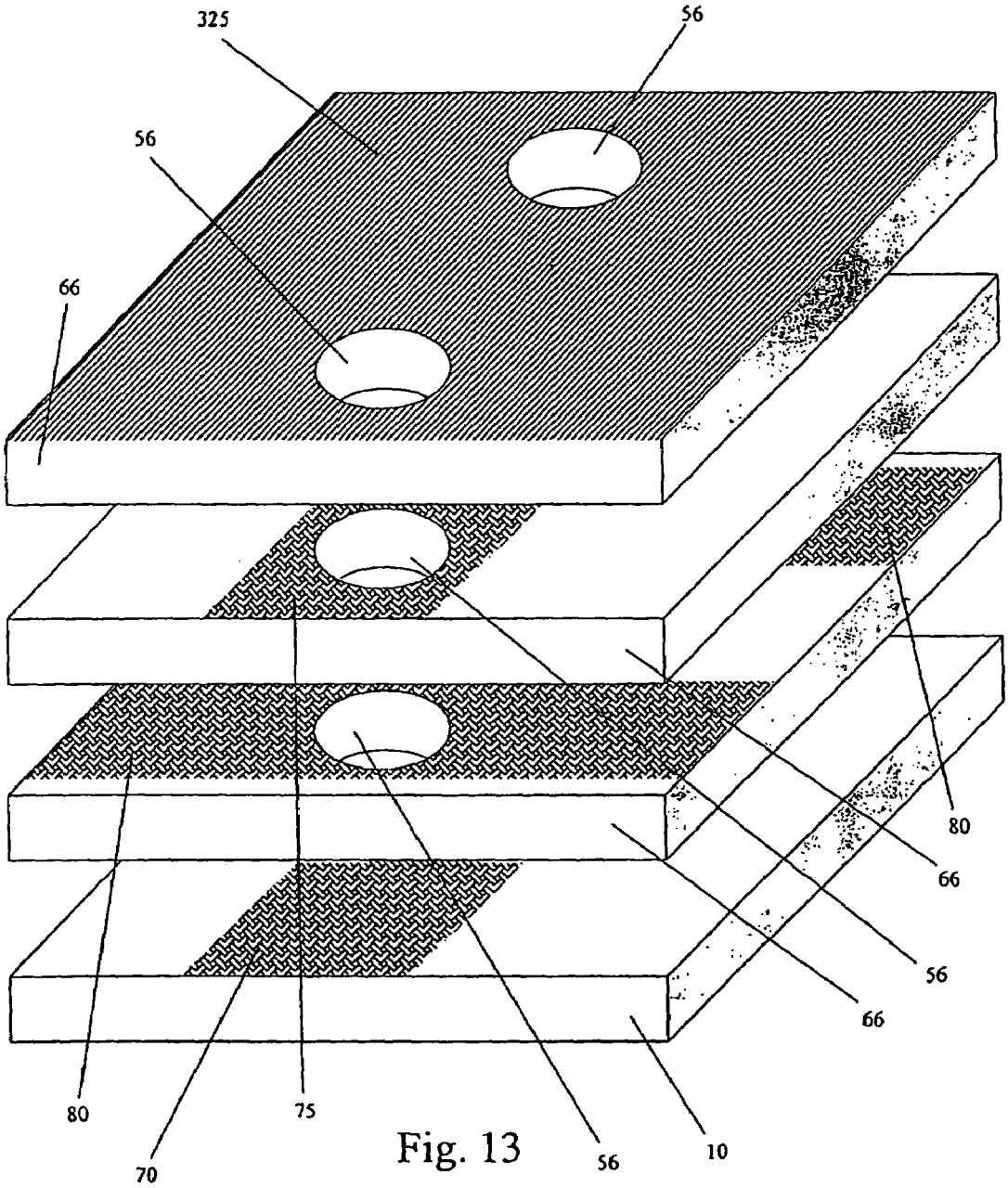
FIG. 13 shows an exploded view of a portion of a light-emitting panel showing the basic socket structure of a socket formed by disposing a plurality of material layers with aligned apertures on a substrate with the electrodes having a mid-plane configuration.
Figure 14:
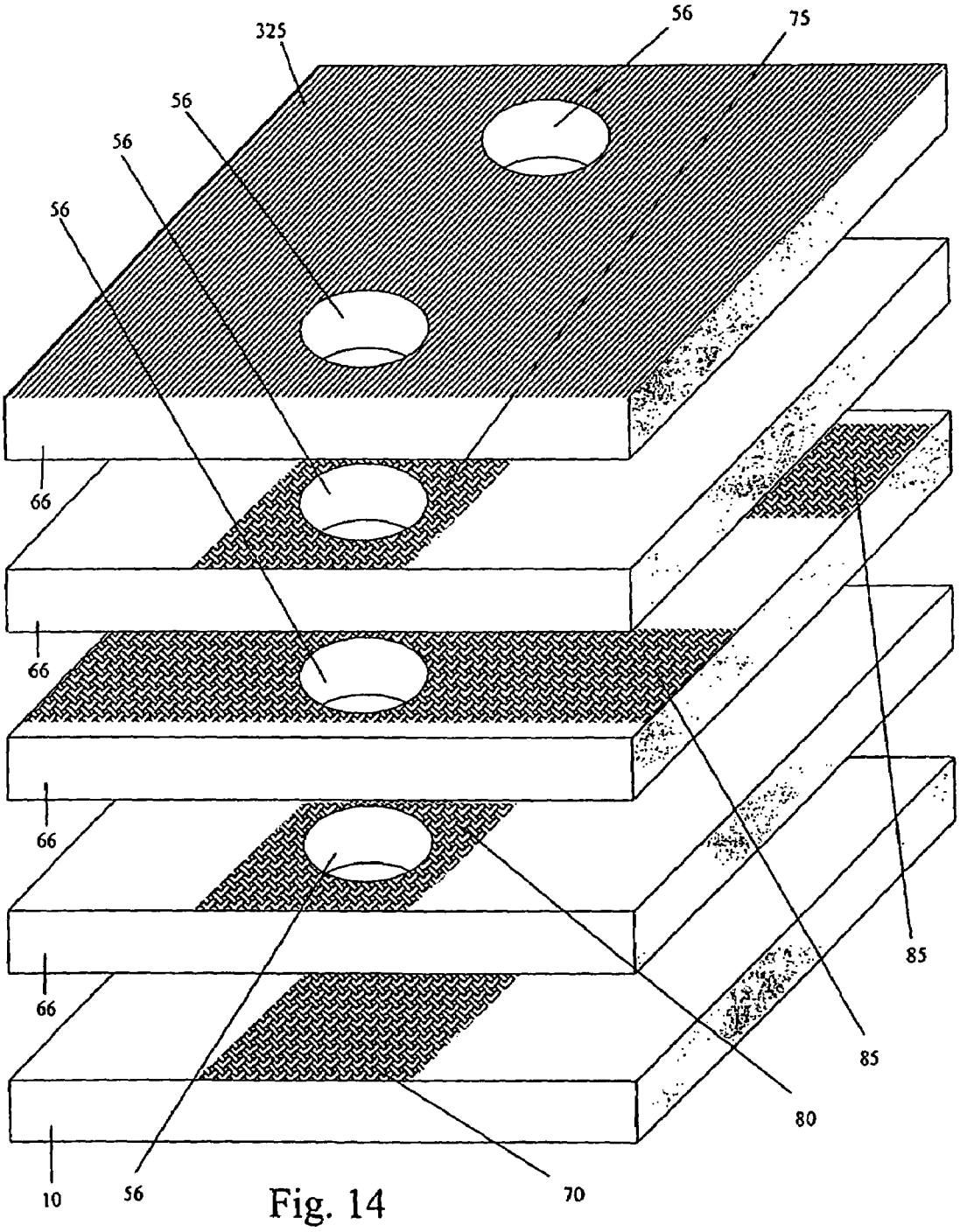
FIG. 14 shows an exploded view of a portion of a light-emitting panel showing the basic socket structure of a socket formed by disposing a plurality of material layers with aligned apertures on a substrate with electrodes having a configuration with two sustain and two address electrodes, where the address electrodes are between the two sustain electrodes.

In an embodiment where a plurality of material layers 66 with aligned apertures 56 are disposed on a first substrate 10 thereby creating the cavities 55, at least two electrodes may be disposed on the first substrate 10, at least partially disposed within the material layers 65, disposed on the second substrate 20, or any combination thereof. In one embodiment, as shown in FIG. 12, a first address electrode 80 is disposed on the first substrate 10, a first sustain electrode 70 is disposed within the material layers 66, and a second sustain electrode 75 is disposed within the material layers 66, such that the first sustain electrode and the second sustain electrode are in a co-planar configuration. In another embodiment, as shown in FIG. 13, a first sustain electrode 70 is disposed on the first substrate 10, a first address electrode 80 is disposed within the material layers 66, and a second sustain electrode 75 is disposed within the material layers 66, such that the first address electrode is located between the first sustain electrode and the second sustain electrode in a mid-plane configuration. In this mid-plane configuration, the sustain function will be performed by the two sustain electrodes much like in the co-planar configuration and the address function will be performed between at least one of the sustain electrodes and the address electrode. It is believed that energizing a micro-component with this arrangement of electrodes will produce increased luminosity. As seen in FIG. 14, in a preferred embodiment of the present invention, a first sustain electrode 70 is disposed on the first substrate 10, a first address electrode 80 is disposed within the material layers 66, a second address electrode 85 is disposed within the material layers 66, and a second sustain electrode 75 is disposed within the material layers 66, such that the first address electrode and the second address electrode are located between the first sustain electrode and the second sustain electrode. This configuration completely separates the addressing function from the sustain electrodes. It is believed that this arrangement will provide a simpler and cheaper means of addressing, sustain and erasing, because complicated switching means will not be required since different voltage sources may be used for the sustain and address electrodes. It is also believed that by separating the sustain and address electrodes so different voltage sources may be used to provide the address and sustain functions a lower or different type of voltage source may be used to provide the address or sustain functions.

Other embodiments and uses of the present invention will be apparent to those skilled in the art from consideration of this application and practice of the invention disclosed herein. The present description and examples should be considered exemplary only, with the true scope and spirit of the invention being indicated by the following claims. As will be understood by those of ordinary skill in the art, variations and modifications of each of the disclosed embodiments, including combinations thereof, can be made within the scope of this invention as defined by the following claims.

What is claimed is:

1. A method for manufacturing a light-emitting panel, comprising:

providing a substrate;

forming a plurality of sockets within the substrate;

placing a micro-component within each of the sockets, each micro-component emitting radiation where a trigger voltage is applied across the micro-component;

forming two electrodes for each of the micro-components; and disposing an electrical enhancement on the substrate, the electrical enhancement for altering an electrical characteristic of the micro-components.

2. The method of claim 1, wherein disposing the electrical enhancement comprises providing the electrical enhancement for lowering an address voltage necessary to ionize a plasma-forming gas within the micro-components.

3. The method of claim 1, wherein disposing the electrical enhancement comprises providing the electrical enhancement for lowering a sustain voltage necessary to sustain an ionization charge in the micro-components.

4. The method of claim 1, wherein disposing the electrical enhancement comprises providing the electrical enhancement for increasing a luminosity transport efficiency of the micro-components.

5. The method of claim 1, wherein disposing the electrical enhancement comprises providing the electrical enhancement for increasing a radiation transport efficiency of the micro-components.

6. The method of claim 1, wherein disposing the electrical enhancement comprises providing the electrical enhancement for augmenting an energizing frequency of the micro-components.

7. The method of claim 1, wherein disposing the electrical enhancement comprises providing the electrical enhancement for altering power requirements necessary to energize the micro-components.

8. The method of claim 1, further comprising individually controlling the electrical enhancement for each of the micro-components.

9. The method of claim 8, wherein individually controlling comprises controlling a luminosity of each of the micro-components.

10. The method of claim 8, wherein individually controlling comprises controlling a frequency at which the micro-components emit radiation.

* * * * *

UNITED STATES PATENT AND TRADEMARK OFFICE

CERTIFICATE OF CORRECTION

PATENT NO. : 7,137,857 B2 
APPLICATION NO. : 10/417256
DATED : November 21, 2006
INVENTOR(S) : Edward Victor George et al.

It is certified that error appears in the above-identified patent and that said Letters Patent is hereby corrected as shown below:

IN THE CLAIMS -

In Column 14, line 4, please change "each micro-component emitting radiation where a trig-" to -- each micro-component emitting radiation when a trig- --

IN THE DRAWINGS:

Please replace Fig. 6A with the following figure (some of the reference numbers were cut off when figure was included in the issued patent):

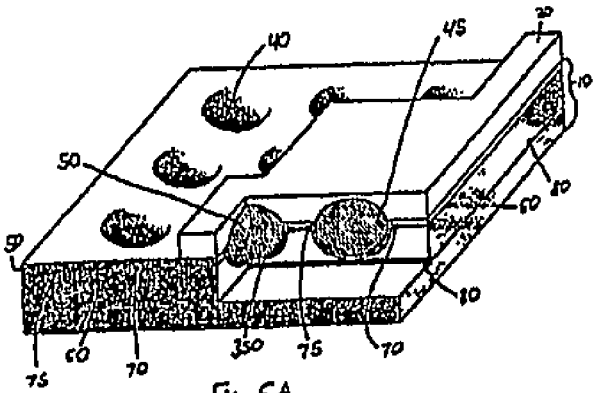

Fig. 6A

UNITED STATES PATENT AND TRADEMARK OFFICE

CERTIFICATE OF CORRECTION

PATENT NO. : 7,137,857 B2
APPLICATION NO. : 10/417256
DATED : November 21, 2006
INVENTOR(S) : Edward Victor George et al.

It is certified that error appears in the above-identified patent and that said Letters Patent is hereby corrected as shown below:

IN THE DRAWINGS:

Please replace Fig. 6B and Fig. 8 with the following figures (some of the reference numbers were cut off when figure was included in the issued patent):

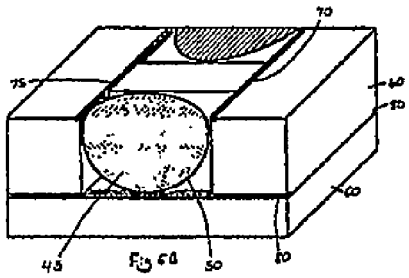

Fig 6B

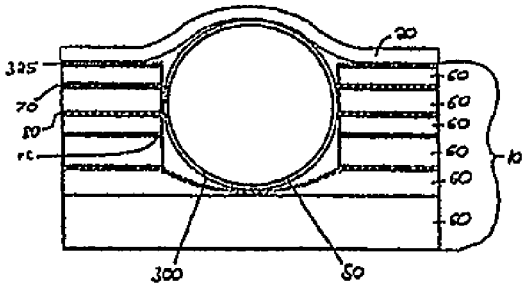

Fig. 8

Signed and Sealed this

Third Day of July, 2007

JON W. DUDAS
*Director of the United States Patent and Trademark Office*